US010731329B1

(12) United States Patent
Novikov et al.

(10) Patent No.: US 10,731,329 B1
(45) Date of Patent: Aug. 4, 2020

(54) REUSABLE MODULAR HOUSING SYSTEM

(71) Applicant: Airbnb, Inc., San Francisco, CA (US)

(72) Inventors: Petr Novikov, San Francisco, CA (US); Joseph Gebbia, San Francisco, CA (US); Christopher Perry Barton, San Francisco, CA (US); Fedor Novikov, San Francisco, CA (US); Lisa Feine Dudley, San Francisco, CA (US); Jaeyoung Huh, San Francisco, CA (US); Nicole Voyen, San Francisco, CA (US); Liang Yao, San Francisco, CA (US); James Nicholas Pazzi, San Francisco, CA (US); David Sharps, Oakland, CA (US); Andrei Goverdovskii, San Francisco, CA (US); Daniel Joseph Chavez, Richmond, CA (US); Miguel Christophy, San Francisco, CA (US); Stefano Pantrerotto, Lausanne (CH); Alexis Fabrice Tourron, Lausanne (CH); Cormac Eubanks, San Francisco, CA (US)

(73) Assignee: Airbnb, Inc., San Francisco, CA (US)

( * ) Notice: Subject to any disclaimer, the term of this patent is extended or adjusted under 35 U.S.C. 154(b) by 0 days.

(21) Appl. No.: 16/203,435

(22) Filed: Nov. 28, 2018

(51) Int. Cl.
*E04B 1/343* (2006.01)
*E04B 1/348* (2006.01)
*E04B 1/24* (2006.01)

(52) U.S. Cl.
CPC ..... *E04B 1/34384* (2013.01); *E04B 1/2403* (2013.01); *E04B 1/3483* (2013.01);
(Continued)

(58) Field of Classification Search
CPC ..... E04B 1/34384; E04B 1/34861; E04B 1/3483; E04B 1/34321; E04B 1/2403; E04B 2001/2436; E04B 2001/2457
See application file for complete search history.

(56) References Cited

U.S. PATENT DOCUMENTS 1,115,260 A * 10/1914 Ward ..... E04B 1/2403 403/173
2,453,221 A * 11/1948 Haden ..... E04B 1/34321 52/461

(Continued)

*Primary Examiner* — Rodney Mintz
(74) *Attorney, Agent, or Firm* — Maynard Cooper & Gale, LLP; Chitra M. Kalyanaraman, Esq.

(57) ABSTRACT

A reusable modular housing system has a gridded structure comprising reusable components with dimensions corresponding to a two-unit system. The structure has floor and ceiling grids with dimensions that correspond to multiples of a first unit of measurement. The vertical beams that connect the floor and ceiling grids are spaced apart at dimensions that also correspond to multiples of the first unit of measurement. The structure has a variety of other components that can be coupled to the floor and ceiling grids and the vertical beams, and those other components have dimensions that correspond to a multiple of a second unit of measurement. Dimensions of the structure can vary, but each of the component parts can be detachably coupled into the gridded structure, so as to fit within the grid's dimensions based on respective multiples of the first unit of measurement and the second unit of measurement. The structure can be assembled into a first configuration, and when use of the structure is completed, the structure can be disassembled into its component parts which can be later assembled into the first configuration or a different second configuration. Use of a two-unit system of dimensions for the system allows for component parts to be reused on the same or other structures designed within the same dimensional system.

11 Claims, 10 Drawing Sheets

(52) U.S. Cl.
CPC ..... *E04B 1/34321* (2013.01); *E04B 1/34861* (2013.01); *E04B 2001/2436* (2013.01); *E04B 2001/2457* (2013.01)

(56) References Cited

U.S. PATENT DOCUMENTS

| | | | | |
|---|---|---|---|---|
| 2,647,287 | A * | 8/1953 | Jones | E04B 1/6183 52/582.2 |
| 3,566,554 | A * | 3/1971 | Schaffer et al. | E04B 1/34321 52/64 |
| 7,178,297 | B2 * | 2/2007 | Seavy | E04B 1/08 52/271 |
| 8,677,698 | B2 * | 3/2014 | Segall | E04B 1/34315 52/127.9 |
| 8,925,255 | B1 * | 1/2015 | Haun | E04D 3/366 52/91.1 |
| 9,016,002 | B2 * | 4/2015 | Segall | G09B 9/003 52/79.5 |
| 9,157,249 | B2 * | 10/2015 | Segall | E04H 1/1205 |
| 9,458,621 | B2 * | 10/2016 | Calafatis | E04B 1/34305 |
| 9,695,608 | B2 * | 7/2017 | French | E04H 1/04 |
| 9,995,327 | B2 * | 6/2018 | Hudson | E04B 1/34321 |
| 10,072,411 | B1 * | 9/2018 | Moran | E04B 1/61 |
| 10,196,807 | B2 * | 2/2019 | Kwong | E04B 1/08 |
| 10,287,770 | B2 * | 5/2019 | Hodson | E04B 1/34321 |
| 10,287,788 | B2 * | 5/2019 | Kwong | E04B 1/34336 |
| 10,465,375 | B2 * | 11/2019 | Fay | E04C 2/46 |
| 2003/0230038 | A1 * | 12/2003 | Seavy | E04B 1/08 52/270 |
| 2009/0223144 | A1 * | 9/2009 | Leahy | E04B 1/34321 52/79.1 |
| 2009/0223161 | A1 * | 9/2009 | Segall | E04B 1/34315 52/588.1 |
| 2015/0292194 | A1 * | 10/2015 | Calafatis | E04B 1/34305 52/67 |
| 2016/0222645 | A1 * | 8/2016 | Fay | E04B 7/12 |
| 2017/0002579 | A1 * | 1/2017 | French | E04H 1/04 |
| 2017/0121961 | A1 * | 5/2017 | Hodson | E04B 1/34321 |
| 2017/0306610 | A1 * | 10/2017 | Leahy | E04B 1/34321 |
| 2017/0350432 | A1 * | 12/2017 | Hudson | E04B 1/34321 |
| 2018/0274221 | A1 * | 9/2018 | Kwong | E04B 1/08 |
| 2018/0334798 | A1 * | 11/2018 | Fay | E04C 2/46 |
| 2019/0010691 | A1 * | 1/2019 | Moran | E04B 2/7401 |

* cited by examiner

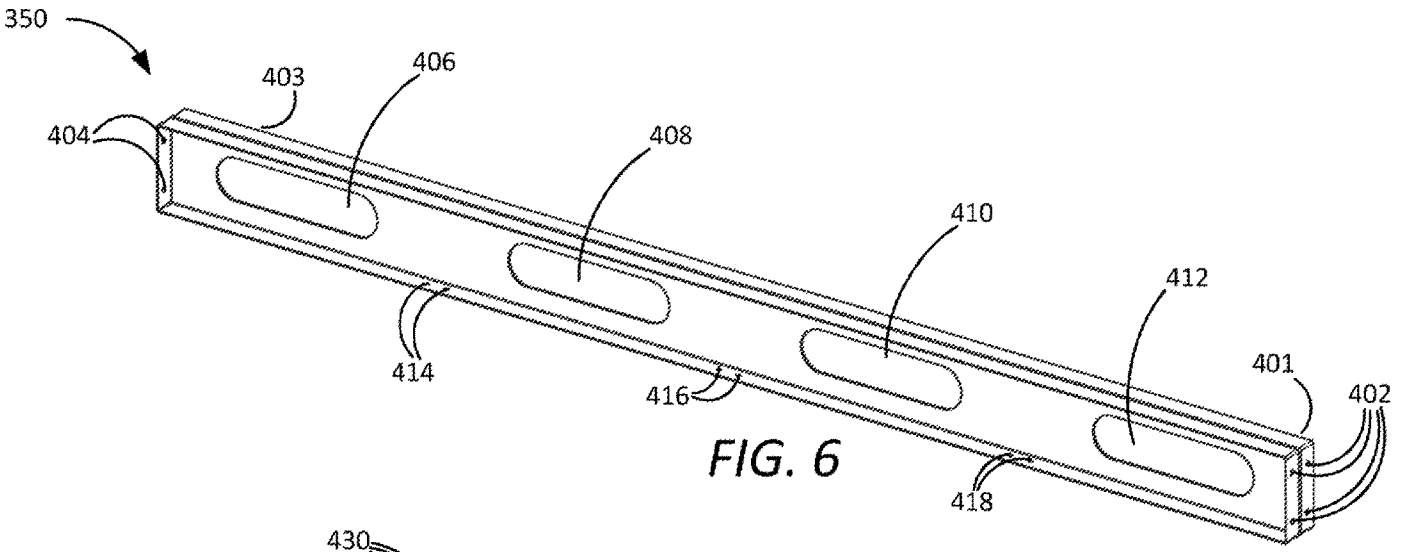
FIG. 6
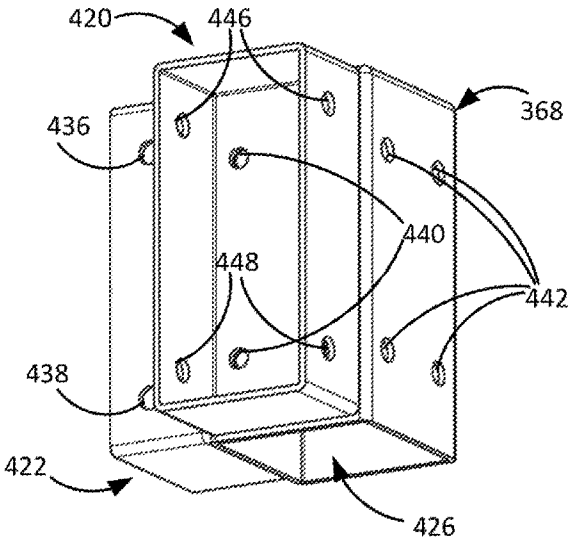
FIG. 7B
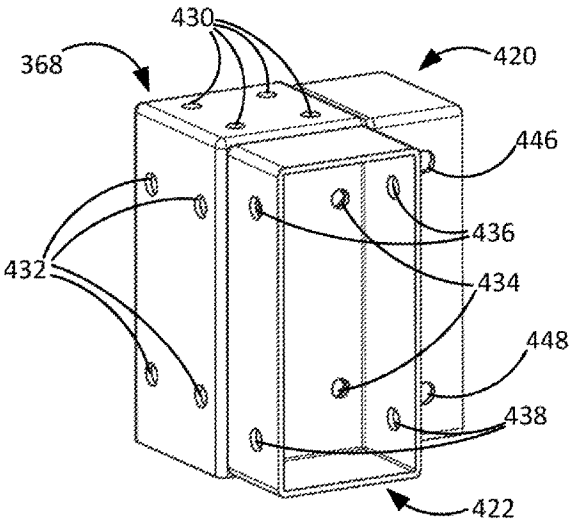
FIG. 7A
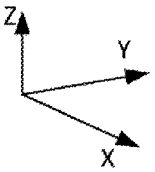

REUSABLE MODULAR HOUSING SYSTEM

BACKGROUND

Residential, commercial, and public properties, such as houses, condominiums, rooms, apartments, lots, campgrounds, and event and/or multi-purpose spaces, among others, often have available space that is underutilized. A property owner may wish to develop that space for short or long-term occupancy, but may be constrained by the practical and monetary investment needed to do so. Additionally, a property owner may be unwilling to commit to the permanency of a complicated or large-scale installation, such as an addition to a residential house, or the construction of a new building.

In a rental context, a property owner (also referred to herein as a "host") may desire to rent a residential property (or a portion thereof) to a guest for a specified time period (e.g., a day, week, month, or other period of time). However, a host's willingness and ability to accommodate guests, and/or the number of guests they can accommodate, may change over time. As a result, a host may, at different times, have differing property capacity (e.g., occupancy) needs. For instance, a prospective host may be interested in temporarily hosting guests to determine whether the hosting process is a good fit. Alternatively, some hosts may temporarily seek to expand the number of guests they can accommodate, such as during busy times like holidays or during special events, when property reservations in an area may be high, and available properties may be scarce. Outside of a rental context, property owners may also wish to temporarily or permanently expand the occupancy capacity of their property for various reasons. For instance, a property owner (including private and/or public agents) may wish to quickly provide additional housing availability during disaster relief crises or refugee housing efforts. Additionally, scheduled or unscheduled events such as conferences, festivals, weddings, tourism, and community needs (for instance, for low-income housing), among other things, may temporarily or seasonally increase the housing needs of a particular property or geographic region.

Traditionally, in this scenario, hosts must decide whether to acquire new property or modify an existing property to meet the capacity needs for hosting guests. Either option may be an unreasonable proposition for a host. Initially, either option may be a prohibitively expensive capital investment. In addition, modification of an existing property may potentially require the host to stop hosting other guests at the property while the modification process is ongoing, thereby losing income. Once complete, the resulting increase in capacity may remain with the host, even when demand for the property falls, thus leaving the host with unneeded capacity and associated expenses. With regard to property rental, the quality of such new or modified property may not match preferences of guests, in which case the host may need to further alter the property.

What is more, the modifications necessary to increase housing capacity may require high-impact changes to the property. For example, building additional housing may require extensive digging of trenches or of a foundation space, or other environmental changes. Additional sources for power, water, and sanitation may also need to be created in order to support the newly-built structure. Such environmental alterations cannot be easily backed out after the need for the additional housing capacity has passed.

Still further, in the case of traditional short-term, temporary properties, there may be a great deal of wasted material after the housing need has passed. In disaster relief scenarios, for example, where new construction is built to house displaced populations, the housing may be destroyed or remain vacant after the immediate need has passed. Because of this waste, to manage cost, such housing must typically be constructed with low-quality materials, which may not satisfactorily meet the needs of the occupants.

In view of the above, a heretofore unaddressed need exists in the art for a high-quality, low-impact property that can be modified as the occupancy requirements or the aesthetic and/or functional goals of the property change, and that can be constructed with minimal waste of material or loss of property utility.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure.

FIG. 6 depicts a roof beam of a reusable modular dwelling system in accordance with some embodiments of the present disclosure.

FIG. 7A depicts a roof node of a reusable modular dwelling system in accordance with some embodiments of the present disclosure.

FIG. 7B depicts an alternative view of a roof node of a reusable modular dwelling system in accordance with some embodiments of the present disclosure.

DETAILED DESCRIPTION

Figure 1:
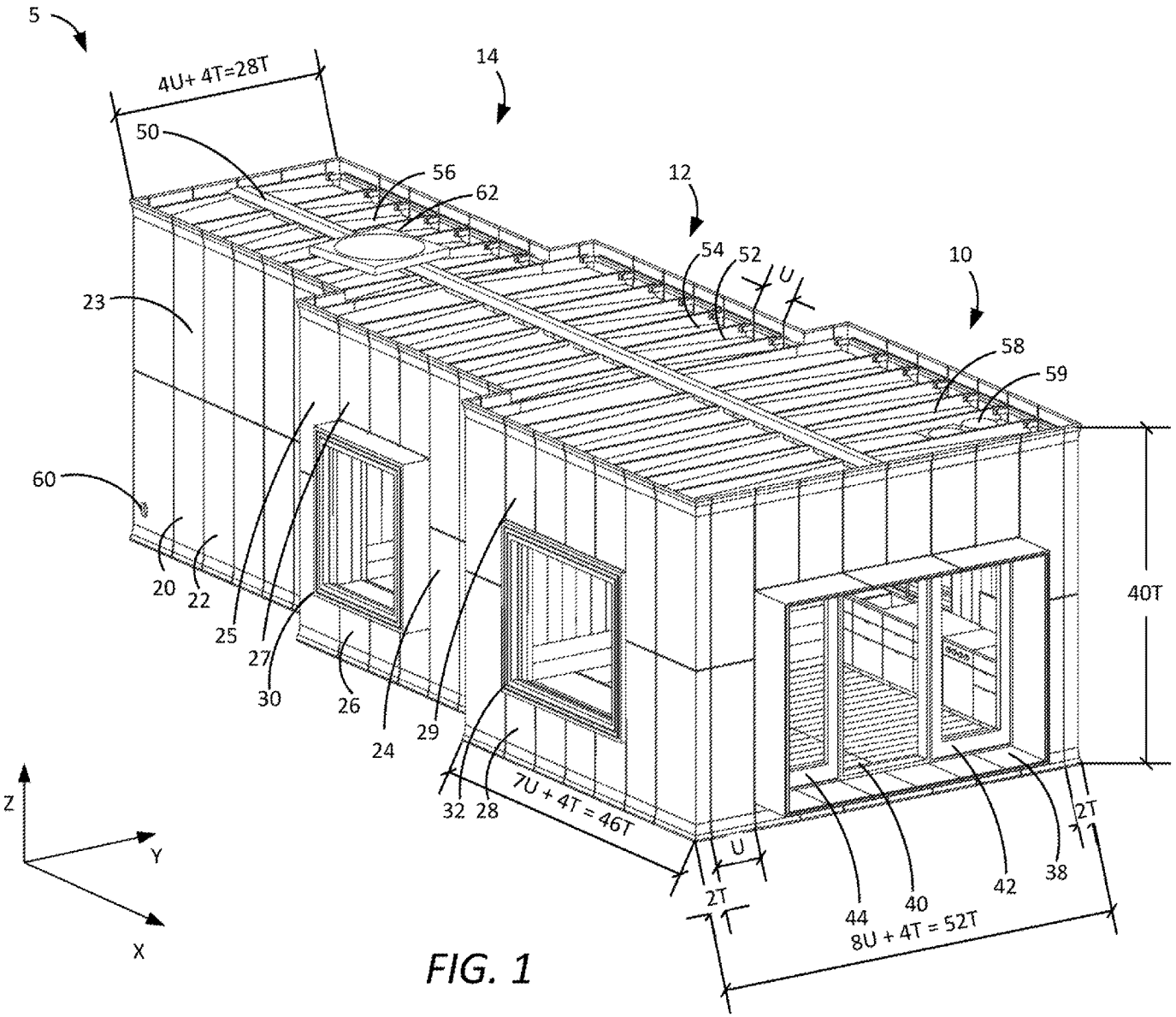
FIG. 1 depicts a reusable modular dwelling system in accordance with some embodiments of the present disclosure.

The present disclosure generally pertains to a reusable modular dwelling system that permits users to select a desired dwelling configuration, assemble the dwelling in a desired location, disassemble the dwelling, and reassemble the dwelling in another desired location, all of which can be accomplished quickly by a small, relatively-untrained crew of assemblers/disassemblers. It will be noted that while this disclosure may, for ease of reference, use the word "dwelling" or "housing," the systems and methods herein are not so limited, and may apply equally to non-residential, commercial, and/or industrial applications. In a preferred embodiment, the reusable dwelling is a stand-alone structure fit for short or long-term human habitation, however, in alternate embodiments, such structure could be built as an add-on to an existing house or other type of building.

In some embodiments, a reusable modular dwelling system has a structure made up of all (or virtually all) reusable components. The structure may be constructed on a gridded system. A first unit value (hereinafter "U," which variable is conceptually derived from, but is not limited to, a "unit" measurement) is used for measurement of the dimensions of a floor grid and a roof grid (also referred to herein as a "ceiling grid") of the gridded system and for setting the spacing of the vertical beams that connect the floor and roof grids. A second unit value (hereinafter "T," which variable is conceptually derived from, but is not limited to, a "tile" measurement) is used for measurement of the dimensions of all of the component parts of the structure that connect to the gridded system components with dimensions that conform to the first unit value. Dimensions of different components of the gridded system may vary, but are always based on respective integer multiples of U and/or T. In a preferred embodiment, the U value is equal to 600 mm [23.62 inches], and the T value is equal to 100 mm [3.94 inches], however, the modular dwelling system may, in other embodiments, have a grid structure that is based on other unit quantities, for example, a U value of 500 mm [19.69 inches].

In an exemplary embodiment, high-quality, durable materials are used in manufacturing the components of the structure, and such components are detachably interconnected in a manner that does not cause physical damage to any component. As a result, after the intended period of use for the structure, the materials themselves have experienced minimal wear and tear, and are in a condition for reuse. Along with this, in the exemplary embodiment, a uniform dimensional system ("two-unit system") is used for components of the grid structure (that is, components standardized against a base T measurement are attachable to structural components standardized to a base U measurement). These two considerations allow for interchangeability and reuse of the components. They also permit variability of architectural design between different structures using the same standard U and T units. The use of components with dimensions coordinating with the two-unit (U and T) standard grid system, or are otherwise fabricated to standardized dimensions to connect to that grid system, helps reduce or eliminate the need for building pieces (e.g., walls and floors) that are specially fabricated for, or cut to fit, a particular structure with a particular configuration, such specialized components being discarded and/or destroyed when no longer needed for that particular structure.

As mentioned, the two-unit system may permit reuse of components in similarly or alternately-configured structures designed in correspondence with the two-unit system. More particularly, a component of the two-unit system may be used to build a structure, and when the structure is eventually disassembled, the same component may be used again to construct a redesigned version of the same structure or another structure (by the same or different property owner), whether or not the configuration (e.g., the layout, size, or floor plan) is consistent between the initial and new structures. While the component parts are primarily intended for incorporation into a structure corresponding to the two-unit system, such parts may also, in some embodiments, have separate utility, so as to be configured for individual sale/resale outside of a "set" of components for a given structural configuration. In some embodiments, the component parts of a structure may include, e.g., exterior cladding, insulating panels (which may include or be separate from shear wall), interior and exterior cladding rails, interior cladding, vertical wall beams, flooring, roof paneling, window frames, beam nodes, door frames, roof beams, foundation beams, floor/ceiling insulation, variable height piers, utility routing, outlets, furnishing, cabinetry, fixtures, and/or appliances, along with other suitable components. The dimensions of these components may be based on the "two-unit system" (also referred to as a "U and T system" or "U/T system") described herein. More particularly, the component parts must be sized so as to enable the floor grid, roof grid, and vertical beam spacing of the structure to adhere to dimensions based on multiples of the above-described first unit U (a first particular length), while component parts attaching to the U-dimension parts generally adhere to dimensions based on multiples of a second unit T (a second particular length).

Use of this two-unit system permits ease of modification of design and configuration of the modular structure during structural reconfiguration. For example, a property owner may select a desired structural arrangement (configuration of, e.g., a number and layout of rooms) and structural size (square footage, height, etc.). In some embodiments, such selection may happen via a software or Internet-based utility for designing the configuration. Such selection may, in some embodiments, be made between one or more standardized sets of materials associated with a predetermined suite of configurations. In other embodiments, the structural arrangement of a particular structure may be selected to a granular level. Changes to size and configuration may, in a preferred embodiment, be implemented in increments that are respective multiples of U or T. For example, based on the desired size and configuration, features of the windows, doors, porches, and other structural features may be configured and positioned at locations on the modular structure. Because the structure's components have dimensions based on multiples of the U and T unit measurements, a builder or assembler may, through adding or removing component iterations of U or T units, construct features of the structure to the building constraints mandated by a property owner's desired size and configuration requirements, and/or in accordance with local planning and building codes. As a result, the owner may specify desired features of the structure, and a targeted set of building components of the structure may be provided (or collected from the existing components that make up an existing structure) to meet those specifications, without the need for new fabrication of structural components, e.g., without having to fabricate or construct new walls, flooring, and/or other features by cutting material to dimensions unique to a particular desired structure. The standardization of base measurements of sizing also aids in the efficiency of shipping and packing of component materials to the structure.

In one embodiment, components for a modular structure can be ordered from a service facility. For example, after the size and configuration of the structure has been selected, an order for the component parts of the selected structure can be placed. In another embodiment, a standard set of components may be selected. At the service facility, the components required to assemble the structure may be identified, packaged, and shipped to a location where the structure will be assembled (that is, an available space on the owner's property). Upon arrival, the component parts of the structure may be unpacked and assembled. In a preferred embodiment, the assembly may be performed by a small, relatively untrained crew of assemblers. This assembly may, in some embodiments, involve the connection of the structure to existing sources of water, power, and sanitation. In preferred embodiments, no extensive trenching or foundation construction is needed.

The structure is constructed in a manner so as to be capable of disassembly back into its component parts. The components remain physically unaltered by the assembly and disassembly process (that is, they are not cut or damaged by, for example, drilling holes, cutting/shaping the part to fit into a particular location, or pressure put upon the part by various forces during a part's functional life in the structure), and therefore, the components may, in various embodiments, be individually or collectively reused to create a replacement structure with a different size or configuration, may be used in the reassembly of the structure in a new location, or may be repackaged and/or returned to a service facility for repair, reconditioning, and/or recycling. Because each structure belonging to the modular dwelling system has dimensions in conformance with the two-unit system, a component part to the system does not have to be specially customized or altered in size or dimension in order to be compatible with most, if not essentially all, structures belonging to the system. In some embodiments, some of the component parts to the modular dwelling system (such as, e.g., insulating, aesthetic, or utility connection components) may be customized or altered to meet aesthetic, cultural, or environmental conditions, such as to withstand temperature or weather conditions specific to a geographical area, or to be compatible with legislative, community, and housing authority codes or standards.

FIG. 1 depicts a reusable modular structure 5 of a reusable modular dwelling system in accordance with embodiments of the present disclosure. In a preferred embodiment, any component of the structure 5 may be configured to decouple from structure 5 when the structure is disassembled and to recouple to the same or a different portion of the structure 5 or to another structure if so assembled. In the preferred embodiment, the reusable modular structure 5 of FIG. 1 is constructed to meet certain dimensions for its flooring and ceiling grids, and certain dimensions of spacing between the vertical beams that connect the flooring and ceiling grids. These certain dimensions define a gridded system onto which the exterior components shown in FIG. 1 (as well as interior components) must conform. A depth (x-direction) of the roof grid and the floor grid may be measured as a multiple of a first unit value denoted by the variable U and a width (y-direction) may also be measured as a multiple of U. The spacing of the vertical beams that connect the roof grid and the floor grid is also measured as a multiple of U. As described herein, other component parts that connect to the U-sized parts are generally measured as a multiple of a second unit value denoted by the variable T.

In the preferred embodiment, the multiples of U and T described herein are integer multiples, however, other embodiments are possible. The respective multiples of U and T, and the relation between U and T described below, are selected to maintain the structural and environmental stability, and the practical utility of the modular structure 5. The overall dimensions of the structure 5 may therefore be described as being part of a "two-unit system," "U and T system," or "U/T system."

In the two-unit system discussed herein, U and T act as base units for measurement in a standard sizing system of the component parts of the reusable modular dwelling system. In the exemplary embodiment of the present invention, U is a base measurement of a system that defines the boundaries of the floor plan of the modular structure 5. For example, as described below, the gridded layouts of the floor plan (floor grid) and the roof (roof grid) of the modular structure, and the placement of the vertical support beams that are required to connect the floor grid to the roof grid, are spaced and sized so as to conform to a base unit measurement of U. T is a base measurement that defines the dimensions of the component parts that connect to the U system "grid." For example, as described below, the floor/ceiling paneling, the cladding, the horizontal rails to which the cladding attaches, the insulation, and other structural features, such as doorways, windows, appliances, and integrated devices of the modular structure (e.g., light switches, vent covers, cabinetry, integrated mirrors, and other integrated components, etc.), among other things, are spaced and sized so as to conform to a base unit measurement of T. T is an integer fraction of U at a granularity that allows the component parts of the modular housing system to be attached within the floor plan boundaries defined by U. Put another way, in the preferred embodiment, the value of T is dependent on the value of U. The particular sizes of U and T may vary in different embodiments, however, for a standard housing structure 5, in a preferred embodiment, U is equal to 600 mm [23.62 inches] and T is equal to 100 mm [3.94 inches].

The selection of 600 mm [23.62 inches] as the base U-spacing and 100 mm [3.94 inches] as a base T-spacing allows for a granulation of component parts that is pragmatic for many standard temporary or short-term housing installations. A "coarser" measurement, for example, a significantly larger value of U and/or T, may not in some circumstances allow for the customization of the housing structure 5 described herein, and may require the physical handling of very large pieces of, e.g., paneling or flooring, which handling might require special equipment or assembly experience. A significantly smaller value of U and/or T (e.g., a "finer" measurement) might in some circumstances require an impractically large amount of component parts to construct a single dwelling.

An illustrative example of a gridded system may be seen with reference to FIG. 2 (to be described in greater detail below). In this example, the "distance" or "separation" between vertical wall beams, that is, the distance between an approximate longitudinal center of a first vertical wall beam 74 (e.g., on a longitudinal centerline of the beam) and an approximate longitudinal center of a second vertical wall beam 75, is equal to 1U (or in some instances, for example, to accommodate a window, a multiple of U). In the same example of FIG. 2, the smallest possible distance between a first horizontal cladding rail 118 and a second horizontal cladding rail 116 (i.e., the respective approximate longitudinal center of each) permitted by the coupling points on the vertical wall beams is 1T (or in some instances, for example, to accommodate a window, a multiple of T). The above examples are merely for illustrative purposes, and particular embodiments will be described in detail below.

It will be understood, of course, that other embodiments may require different base dimensions, that is, different types of buildings may require larger or smaller spaces and/or more customization, and therefore, a coarser or finer granulation of component parts may be appropriate in such scenarios. As just one example, some structures may need larger doorways, such as those that must facilitate the passage of furniture or machinery (e.g., temporary hospitals or workspaces) or must meet particular requirements of the Americans with Disabilities Act (ADA) or other regulatory compliance standards. Such structures may instead use a U value of 500 mm [19.69 inches] (or another appropriate size), which size allows for doorways or other components to be scaled to correspond to a distance between vertical wall beams of, e.g., 1U, 2U, or greater, as appropriate, and similarly, may use another T value as appropriate. In other embodiments, other conditional circumstances may dictate other appropriate base sizes for U and T.

It will be understood that the width, depth, and height of the modular structure 5 may vary at different portions, that is, the structure need not be generally rectangular in shape (as, for example, a mobile home, trailer, or a traditional temporary or semi-permanent facility might be), but may instead have one or several rooms that vary in several dimensions. However, even as the structure varies, the particular width, depth, and/or height values at any of the floor grid, ceiling grid, and walls of the structure 5, or components attaching thereto, will, in the preferred embodiment, conform to dimensions of respective multiples of the U and/or T values.

With reference once more to FIG. 1, the exemplary modular structure 5 has a plurality of rooms 10, 12, and 14. Each of the rooms 10, 12, 14 has (as defined by the spacing between its gridded vertical beams) a respective width (y-direction) that is a multiple of U. Each of the rooms 10, 12, 14 has (as defined by the spacing between its gridded vertical beams) a respective depth (x-direction) that is also a multiple of U. The number and horizontal placement of vertical beams that delineate a room are therefore defined by multiples of U. Each of the rooms 10, 12, 14 also has (as defined by the height of its vertical beams) a respective height (z-direction) that is a multiple of T. As an example, the illustrated first room 10 may have a width of 8U, a depth of 7U, and a height of 40T. A second room 12 may have a width of 6U and a depth of 7U. A third room 14 may have a width of 4U and a depth of 7U. It will be understood that the above-mentioned distances are presented merely for exemplary purposes, and any practical multiple of U and/or T may be used, provided the configuration is structurally sound. The heights of each of the rooms 10, 12, 14 are shown as being approximately equal in FIG. 1, but in some embodiments, all or a portion of a room may be of a height that is a multiple of T different from one or more heights of other rooms of the structure 5. In alternate embodiments, one or more rooms may have a slanted or irregularly-shaped roof or walls, or may contain additional structures on its roof or walls, such that the width, depth, and height of a room may vary within the room itself.

The modular structure 5 is illustrated in FIG. 1 with three rooms 10, 12, 14, however, as noted above, the structure 5 may be configured to have any practical number of rooms with various dimensions, each of which can be positioned relative to other rooms of the structure 5 as desired (provided such layout is structurally sound). In addition, a room may be configured to have a wall grid of a desired width and depth, both of which are multiples of U. For example, although the three rooms 10, 12, 14 have been arranged in FIG. 1 such that their mid-lines (that is, virtual lines that include the room's central midpoints) are essentially aligned along the same axis, in some embodiments, one or more rooms may instead be arranged at various angles with respect to the midlines of one or more other rooms, such as at a 90° or other angle relative to the central axis of the one or more rooms. In addition, although the structure 5 is depicted in FIG. 1 as having a single-story configuration, in some embodiments, the structure 5 may be configured to have two or more stories. For example, another (second) floor may be provided above a first (ground) floor of the structure 5, the first floor having access to the second floor via a staircase, ladder, elevator, pulley, or other structure (not specifically shown).

FIG. 1. depicts an exterior of an embodiment of the modular structure 5, therefore the exterior-facing component parts of the modular structure will be discussed first herein. In the embodiment of FIG. 1, the exterior of the structure 5 (that is, the outermost portion that is exposed to the elements) includes one or more panels 20-29. In some embodiments, this exterior paneling takes the form of insulating panels positioned adjacent to one another to provide an exterior surface of the structure 5. The insulating panels are connected to a series of horizontal and vertical beams (described in more detail below with reference to FIG. 2) that correspond to the U/T dimensions of the structure 5. In some embodiments, exterior cladding panels (described in more detail below) may be attached directly or indirectly to the insulating panels so as to be the exterior-facing components.

Panels 20-29 may be positioned (e.g., snugly fitted to each other and the bounds of the structure 5) so as to prevent incursions into the structure. In some embodiments, each of the panels 20-29 may have an approximately uniform width. In the embodiment shown in FIG. 1, each of panels 20-29 has a width corresponding to a multiple of T. In the illustrated embodiment, the width of a panel that is central to a wall (i.e., not on the wall's side edges), such as panels 20, 22, 24, 26, and 28, may be 6T in width (where 1U=6T), thereby bridging the space defined by the distance (of 1U) between the vertical beams to which the paneling is (directly or indirectly) attached.

Other widths may be possible in other embodiments, for example, to accommodate a necessary offset or clearance (e.g., a buffer space) between panels, should the material of the panels require such offset. In one such example, some clearance between panels may be used to account for environmental factors, such as expansion/contraction of the panel materials (or ice that collects therein) in extreme temperatures. A clearance between panels may also assist in providing access for repair, maintenance, or access to interior components. The amount of clearance may also be dependent in some embodiments on the thickness or material properties of the panel. In this regard, in one embodiment, the panels may need to be spaced at a certain distance apart (e.g., 6 mm [0.24 inches] for some materials); in such a circumstance, where the distance between the vertical beams providing support is 1U and where 1U=6T (U=600 mm [23.62 inches] and T=100 mm [3.94 inches]), the actual width of the panel needed to accommodate the U spacing of the beams is 6T−3 mm [0.12 inches]−3 mm [0.12 inches]=6T−6 mm [0.24 inches]. It will be understood that the panels are standardized in dimension during fabrication to account for such clearance, rather than cut or sanded to size during assembly to fit the panels into place. However, due to the variability in the possible measurements necessary for clearance (which are dependent on material and environment, at least), for ease of reference in this disclosure, the fact that clearance or spacing may be needed around a panel in some embodiments may be taken herein as given. That is, in this disclosure, a panel of, for example, a width of 6T−6 mm [0.24 inches] may be discussed herein as having a width of 6T, but it will be understood that such panel may vary in height or width to accommodate necessary offset values, while still falling within the bounds of this disclosure if it is sized to fit to the U/T system described herein. Through this disclosure, it will be understood that in a preferred embodiment, the paneling (and in some cases, other components) of the structure 5 may include one or more tolerances to allow for normal use in different conditions. In another embodiments, the value of an offset may be zero (that is, no offset is needed).

Some of the panels, such as panel 25, are located at an edge or corner of a side of a wall; with respect to panel 25, the edge of a wall of room 12. The width of such a corner panel includes not only the distance between the vertical beams to which the panel is attached, but also enough distance to extend beyond the corner beam and against the rear-facing panel on the other side of the corner. This creates a corner wall that follows around the position of the vertical beam (accounting for the thickness of the panels). In the illustrated embodiment, where 1U=6T, the width of the corner panel 25 is 8T, which is 2T+the distance between the vertical beams to which the panel connects (which is 1U). It will be noted that, in the example of FIG. 1, the multiple of T used for the exterior panels generally correlates to U (that is, the panels are a width of approximately 6T, which is equal to U), however, other embodiments need not be so correlated, as long as the panels conform in dimension to respective multiples of T. In addition, embodiments may be possible where the width of the exterior panels along the y-axis side of the structure 5 is different from the width of the exterior panels along the x-axis side, or where different panels of different widths are positioned on a single side of the structure.

In the preferred embodiment, the number of multiples of T is chosen so as to allow a whole number of panels to fit within the architectural dimensions defined by the placement of the railings, roof, floor, windows, doors, and other components of the structure 5. For example, with reference to FIG. 1, if the vertical railings of the first room 10 are spaced apart at a total width of 8U, panels are arranged to cover that width. As described above (where 1U=6T), panels not on the edge or corner of the room (like panel 28) may have a width of 6T while panels on the corner (like panel 25 of room 12) may have a width of 8T (that is, 6T+2T). Therefore, the total width of the exterior panels on the y-axis wall of room 10 in the illustrated embodiment of FIG. 1 is (8×6T)+4T, or 52T. Therefore, it would be possible in the illustrated embodiment to use any combination of panels, with any permutations of widths of multiples of T, so long as the respective widths add up to 52T across the width of the first room 10 between the corner panels (accounting for the 2T (or otherwise T-sized) extension on the corner panels). The panels may then be settled into place snugly to create a close fit (accounting for any clearance or spacing), without any need for cutting, shaping, or other customization of the width of the panels. Other considerations may also factor into the choice of the number of multiples of T. For example with regard to FIG. 1, in an embodiment where it is desired (for, e.g., convenience or aesthetics) that the width of the panels along the y-axis and the x-axis be the same, and the width of the first room is 52T (based on a total room width of 8U, defined by the vertical wall beams) and the depth of the first room is 46T (based on a total room depth of 7U, defined by the vertical wall beams), a central panel with a width of 1T, 2T, 3T, or 6T (not accounting for any clearance between panels) would provide an integer multiple of panels that could be commonly arranged across both the x- and y-dimensions.

In some embodiments, the panels may have varying heights, even when on the same side or room of the structure 5. Although various dimensions are possible, as shown in FIG. 1, panels 20 and 22 have a height equal to a multiple of T (minus any necessary clearance between panels) that is approximately ½ of the height of the structure (the structure's total height being approximately 40T in the example embodiment). In some embodiments, a panel may have a height that is approximately equal to the height of the structure 5, such that only one exterior cladding panel may be needed for each unit of depth U of the structure 5. In other embodiments, a panel may have a height as small as 1T. As another example, panels 20, 22, 24 illustrated in FIG. 1 have a width of 6T, and a height that is approximately ½ of the height of the structure (the height of the structure being approximately 40T). With reference to the illustration of FIG. 1, panels 26, 27, 28 and 29 have a width of 6T, but have a height that is less than the height of the panels 20, 22, 24. This panel height may be based on a multiple of T that represents a distance between a feature (e.g., a window) and a top/bottom boundary of the structure (e.g., an edge of the roof or foundation of the structure 5). For example, panels 26 and 28 are positioned below windows 30 and 32 respectively, while panels 27 and 29 are positioned above windows 30 and 32 respectively. Panels 26 and 28 may have a height that represents a vertical distance from the foundation of the structure 5 (e.g., the ground or, in some embodiments, the top of a foundational structure (not shown in FIG. 1)) to the bottom of each of windows 30 and 32 respectively. Panels 27 and 29 may have a height that represents a vertical distance from a point on the roof of the structure 5 to the top of each of the windows 30 and 32 respectively.

It will be noted that, not accounting for any clearances/tolerances, regardless of whether a panel is positioned on the structure 5 to be above or below a feature such as a window 30, 32 or a door 40, or whether the panel is a part of the wall of the structure where no such features present, the height of the panel is, as described above in the preferred embodiment, a multiple of T. In a manner similar to that described above with respect to the width of the insulating panels, in the preferred embodiment, the number of multiples of T for the height of a panel is chosen so as to allow a whole number of panels to fit within the dimensions defined by the height of the structure 5 (at the particular portion of the structure 5 at which the panel is to be placed), without any need for cutting, shaping, or other customization of the size of the panels.

The modular structure 5 is illustrated in FIG. 1 with a plurality of windows, including a first window 30, a second window 32, and a third window 40. As noted above, each of the windows 30, 32, 40 has dimensions that correspond to the two-unit system. The windows 30, 32, 40 may each have a respective width, both of which are multiples of T, corresponding to the respective multiples of U between the vertical beams to which the windows connect, and a respective height that also is a multiple of T. That is, the windows 30, 32, 40 fit in the space defined by the distance between the vertical beams and horizontal railings, the distance between the vertical beams being a multiple of U, and the distance between the horizontal railings being a multiple of T. The actual width, depth, and height of the window depend upon, for example, the size of the framing around the window (which framing may be variable in size, to the extent permitted by the U/T frame), so are referred to herein by the U/T measurements that define their available space. It will also be understood that the width and height of a window may in some embodiments account for clearances between paneling on the structure. With this in mind, window 30 of FIG. 1, for example, has a width 18T that corresponds to the distance 3U between the wall beams (the same width 18T as the three adjacent exterior panels 26 that border the bottom of window 30, taken together). The window 32 of FIG. 1 has a width of 24T that corresponds to the distance 4U between the wall beams (the same width 24T as the four adjacent panels 28 that border the bottom of window 32, taken together). It will be understood that the windows of structure 5 may be of any practicable size; to that point, the size of any single window may not exceed the height or width of the structure 5 itself or of a room, and the positioning of a window must allow for the presence of sufficient supporting beams for the structure (described in greater detail below). In the embodiment of FIG. 1, window 30 is depicted as having a height that is approximately equal to the height of window 32, but in some embodiments, windows may have different heights that may depend on a desired location of the window, and the structural needs and desired features and configuration of the structure 5, such as with windows 30 and 40. The framing around a window corresponds to the height and width of a window, e.g., window 30. In one embodiment, the window frame may extend from the structure (e.g., to provide an overhang) at a distance of 1T, but in other embodiments, that distance need not correspond to the U/T system. To explain further, the portions of window framing that connect to the structure 5 conform to U/T measurements, while the portions of window framing that extend away from the structure 5 may extend at a distance that is not in conformance, as such distance does not affect the framing's fit to the structure.

Figure 4:
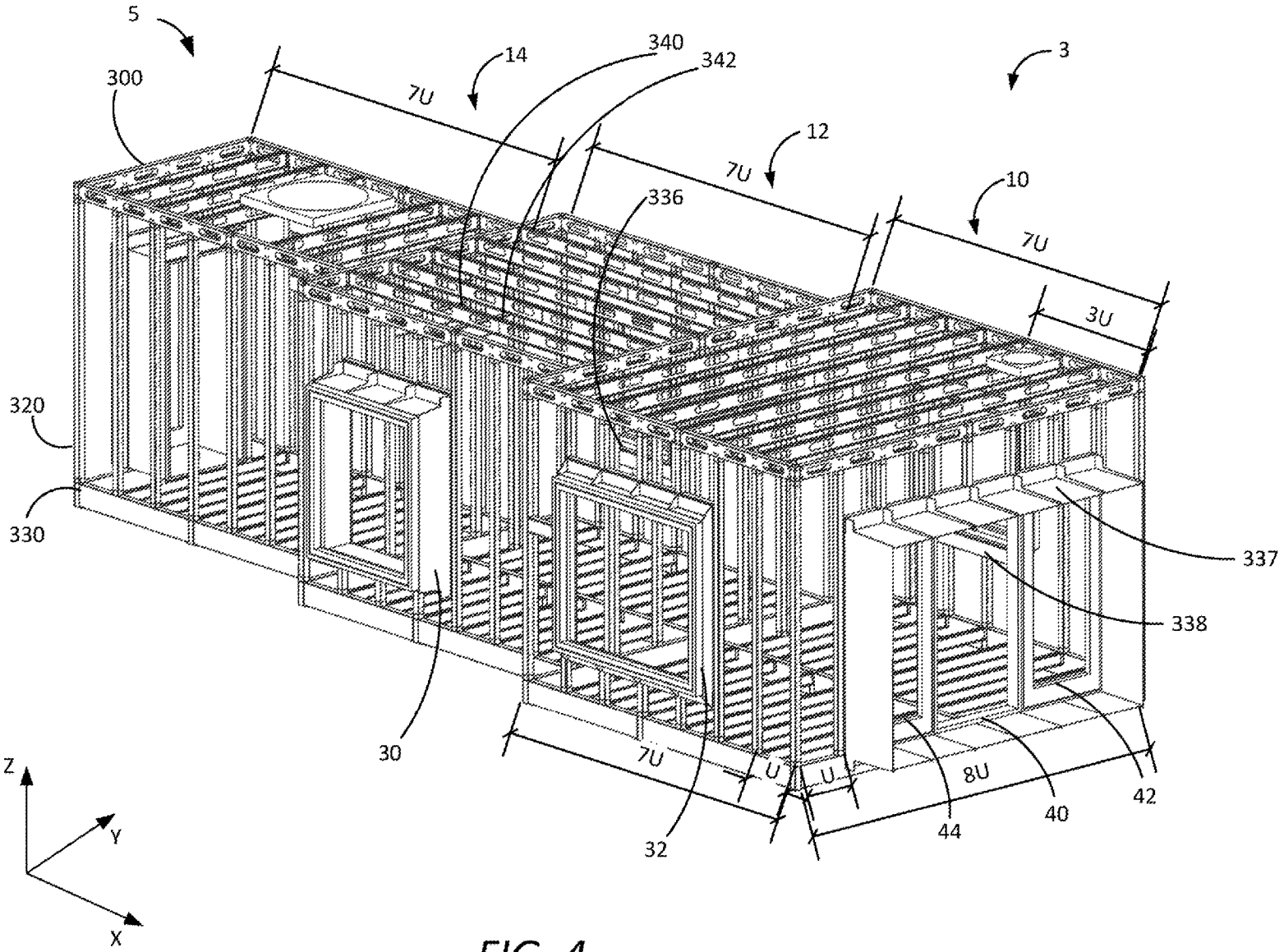
FIG. 4 depicts an alternative view of a reusable modular dwelling system in accordance with some embodiments of the present disclosure.

In some embodiments, the structure 5 shown in FIG. 1 may also have a porch frame 38. As described above with respect to the windows, the actual width and height of the porch frame depend upon, for example, the size of the framing and other material around the window (which framing may be variable in size, to the extent permitted by the U/T frame), so are referred to herein by the U/T measurements that define their available space. The porch frame 38 therefore has a width of 36T (corresponding to the total beam distance 6U between the vertical beams defining the space for the porch) in the embodiment of FIG. 1, but in other embodiments other widths are possible. In addition, the porch frame 38 has a height that is a multiple of T larger than that of the windows 30 and 32. Doors 42 and 44, as shown in FIG. 1, are adjacent to the window 40, and have a width of 12T (corresponding to a beam distance of 2U) each. Likewise, keeping to the same convention, the window 40 of FIG. 1 has a width of 12T (corresponding to a beam distance of 2U). Each of the window 40 and the doors 42 and 44 has a respective height that is configured to fit within the porch frame 38. In one embodiment, a portion of each of the window 40 and the doors 42 and 44 may be coupleable to the porch frame 38. In other embodiments, the window 40 and doors 42 and 44 may couple to horizontal framing beams (not specifically shown in FIG. 1). In some embodiments, the porch frame 38 may have portions that extend to shield occupants from precipitation or to shade the doors 42 and 44 and window 40 (e.g., an awning or overhang). FIG. 4, for example, illustrates an overhang 337 to protect people entering or exiting the structure through the doors 42 and 44. In a preferred embodiment, overhang 337 extends from the structure 5 by a distance that is a multiple of T. In other embodiments, awnings and/or overhangs may be of other lengths (and need not correspond to the U/T system) and/or may be located at other points on the structure. Turning again to FIG. 1, the porch frame 38 may also have a floor or step that provides easy access to occupants as they pass through doors 42, 44.

As shown in FIG. 1, structure 5 also may have a roof 50 with components such as roof panels 52, 54, 56, and 58 that are configured to fit adjacently to other roof panels to protect the interior and exterior of structure 5. The roof panels 52 and 54 have width and depth dimensions similar to those of the exterior panels described above. Roof panels toward the middle of the structure may have a certain width and/or depth (e.g., 6T) while roof panels toward the edges of the structure may be slightly larger (e.g., 6T+2T=8T) so as to overhang the roof beams and wall beams underneath and snugly meet their corner-adjacent wall panel/molding. In a manner similar to that described above with respect to the width and height of the exterior panels, in the preferred embodiment, the numbers of multiples of T for the width and depth dimensions of the roof panels 52 and 54 are chosen so as to allow a whole number of roof panels to fit within the U-dimensions of the roof grid (at the particular portion of the structure 5 at which the panel is to be placed), without any need for cutting, sanding, shaping, or other customization of the size of the roof panels.

For example, in the embodiment depicted in FIG. 1, roof panels 52 and 54 have a depth of a multiple of T (e.g., 6T, not accounting for clearance between panels as described above), and a width that is approximately ½ of a width of the section of the structure 5 over which the roof panels are positioned, though other widths are possible. For example, roof panels 52 and 54 may have a width that is approximately ½ of the width of room 12 of structure 5 (the central room shown in FIG. 1), roof panel 56 may have a width approximately ½ the width of room 14 (the leftmost room shown in FIG. 1), and roof panel 58 may have a width approximately ½ of the width of room 10 (the rightmost room shown in FIG. 1). Roof panels may have other dimensions in other embodiments. Note that the roof panels 52 and 54 are positioned essentially behind the insulating panels (with respect to the exterior of the structure 5), and adjacent to one another. In this regard, panels 52 and 54 may be configured to be positioned in order to provide a barrier to prevent outside elements from entering the structure, such as precipitation.

It will be understood that the exterior of modular structure 5 may have additional features that are not in FIG. 1. For example, structure 5 may have various numbers of windows, skylights, doors, or other features. FIG. 1 illustrates skylight windows 59 and 62 located in different locations on roof 50. Structure 5 may also be coupled to various resources such as appliances or systems for performing necessary functions and/or utilities, that is, dynamic functions as power management/electrical, heating, ventilation, air conditioning (HVAC), sanitation/sewage/plumbing, water, data or telephone connections, and the like. In this regard, utility ports such as port 60 may be present on one or more portions of structure 5. In FIG. 1, port 60 is depicted as being installed on the bottom of room 14, but in other embodiments, the ports may be found in other locations, such as a top or side of the structure 5, underground, or in a space between the floor of the structure and the ground. Note that port 60 may have dimensions corresponding to the two-unit system (or may connect to/interact with components corresponding thereto), and may be configured to decouple from structure 5 when the structure is disassembled and to recouple to the same or a different portion of the structure 5 or another structure if desired.

In a preferred embodiment, port 60 connects to existing sources of utilities, without the need for dedicated utility lines or extensive trenching, however, in some embodiments, some amount of trenching may be appropriate. However, in alternate embodiments, dedicated sources for utilities may be installed so as to be attached to or in proximity of the structure 5, with such dedicated sources being connected to ports 60 that are located at different points on the structure 5. Examples of dedicated sources for functions/utilities may include, for example, generators, gray-water systems, clean water supply, sewage lines, electrical mains, data/internet connections, telephone lines, and the like. In preferred embodiment, port 60 may be sized to be 1T, or a multiple of T, in width or height, however, in other embodiments, other sizes necessary to accommodate particular types of utility lines are possible.

Figure 2:
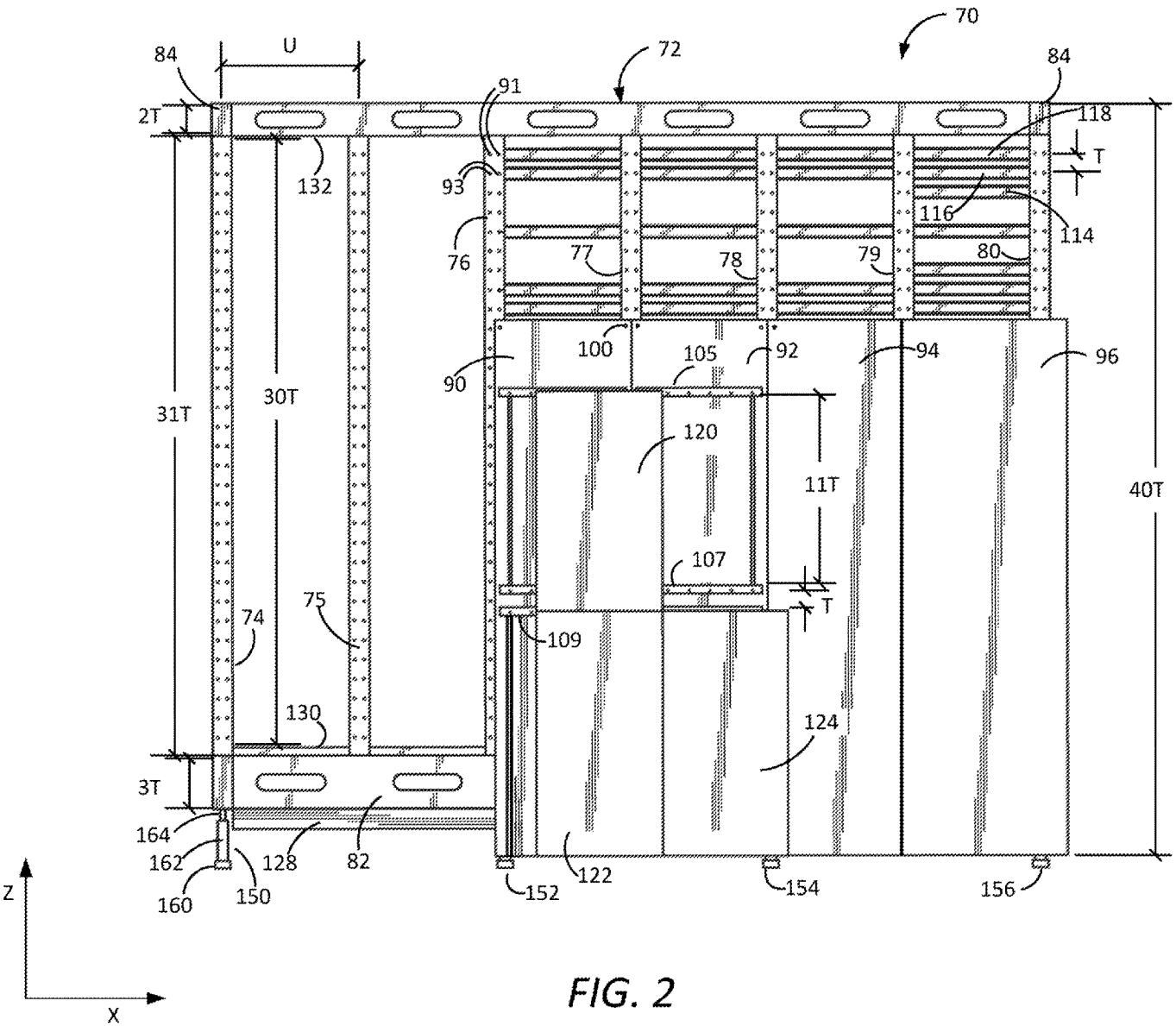
FIG. 2 depicts a view of a wall of a reusable modular dwelling system in accordance with some embodiments of the present disclosure.

FIG. 2 depicts a side view of components of a wall 70 of the structure 5 in accordance with some embodiments of the present disclosure. FIG. 2 shows a roof beam 72 that is coupled to a plurality of vertical wall beams 74-80. As illustrated, roof beam 72 connects to vertical beam 74 via a roof node 84 (described in greater detail below). The distance between two roof nodes (the center of the nodes) corresponds to a multiple of U, therefore the roof beam 72 situated between two such nodes has a depth that corresponds to a multiple of U minus ½ of the width of each of the roof nodes 84 on opposite ends of the roof beam. That is, the roof beam 72 has dimensions that enable the roof nodes 84 to be spaced in conformance with the U/T system. It will be understood that the depth of roof beam 72 is in correspondence with the dimensions of the intended room configuration. As one example, with respect to FIGS. 1 and 2, a roof beam over room 10 of structure 5 (which room has a depth of 7U) may have a depth of 7U minus ½ of the width of the roof nodes. The height of the roof beam 72 may vary in different embodiments and need not itself conform to a U or T multiple, but will be understood to be generally standardized for fabrication. To explain differently, the elements of the roof beam that connect or couple (or are connected or coupled) to the vertical and/or horizontal wall beams will conform to the respective U/T measurements of the beams, while the elements of the roof beam that do not so connect (e.g., the height thereof) need not strictly follow U/T dimensions. Of course, different multiples of U and/or T may be used in different embodiments. The features shown in wall 70 of FIG. 2 are exemplary, and other walls of the structure 5 may have similar features.

In some embodiments, the plurality of vertical wall beams 74-80 may have essentially the same thickness dimensions as the roof beam. In the illustration of FIG. 2, one vertical wall beam 74 of FIG. 2 has a height equal to the distance from the roof to the flooring (e.g., 31T) (minus the sizes of the connective roof and/or flooring nodes to which it couples). A vertical wall beam may in some embodiments have a height equal to the height of the entire structure 5, or equal to the distance from the floor to the bottom of a window, or from the roof to the top of a window or door, among many other examples. Other dimensions for any of the wall beams 74-80 may be possible in other embodiments. In the embodiment of FIG. 2, a vertical wall beam is separated from an adjacent vertical wall beam by a distance of 1U, though other distances are possible in other embodiments, e.g., to accommodate windows, doors, or other openings, so long as the vertical wall beams are spaced at distances corresponding to respective multiples of U. As used herein, a "distance" or "separation" between vertical wall beams may refer to a distance between an approximate longitudinal center of a first vertical wall beam (e.g., on a longitudinal centerline of the beam) and an approximate longitudinal center of a second vertical wall beam. For example, in the embodiment of FIG. 2, a distance between a centerline of vertical wall beam 74 and a centerline of vertical wall beam 75 is approximately equal to 1U. Thus, herein, vertical wall beam 74 may be described as being "separated" from vertical wall beam 75 by a distance of approximately 1U. Additionally herein, a "separation" or "distance" between any two or a plurality of essentially any component of structure 5 may similarly refer to a distance measured from a centerline or longitudinal center of components as may be apparent based on the two-unit system described herein.

Similarly, in FIG. 2, the respective distances between beams 75 and 76, beams 76 and 77, beams 77 and 78, beams 78 and 79, and beams 79 and 80 are also each approximately equal to 1U. Thus, each of the centerlines of the respective vertical wall beams 74 to 80 may be approximately 1U from the centerline of respective adjacent vertical wall beams 74 through 80. As a further example, the vertical centerline of vertical wall beam 74 is separated from the vertical centerline of vertical wall beam 75 by a distance of 1U, while the vertical centerline of vertical wall beam 76 is also separated from the vertical centerline of the wall beam 75 by a distance of 1U. In other embodiments, the distances between vertical wall beams may be different multiples of U. In addition, as illustrated in FIG. 2, each of the vertical wall beams may have an essentially square cross-section, but in other embodiments, other shapes of cross-sections of the vertical wall beam may be possible.

In some embodiments, the plurality of vertical wall beams 74 to 80 may have coupling points on one or more sides of the vertical wall beam. These coupling points can be holes or slots for receiving fasteners or coupling devices, such as pins, bolts, slots, or snap connectors, among others. In some embodiments, horizontal beams 114, 116, 118 (also referred to herein as horizontal rails) may be coupled to the vertical wall beams by a inserting a pin or bolt through a hole in the horizontal beam and through the coupling point of the vertical wall beam, though other types of coupling mechanisms may be used. In the exemplary embodiment, the coupling points may be separated by distance of T or a multiple of T. By this same token, it will be understood that the horizontal beams may be uncoupled (separated) from the vertical wall beams by removing the pin(s) or bolt(s) from the coupling point of the vertical wall beam, and from the hole in the horizontal beam. No nails, self-drilling screws, glue, beveling, cuts, or other "permanent" alterations are made or added during the coupling or decoupling process, and there is no need to pry or force the horizontal beam away from one or more vertical beams during the decoupling. Because of this, after the uncoupling of the horizontal beams from the vertical wall beams, both the horizontal beams and vertical wall beams remain undamaged or unmodified by the coupling and decoupling—that is, the physical condition of those components after the decoupling is relatively the same as before the coupling (though normal wear and tear over time may be expected).

FIG. 2 illustrates that vertical wall beam 76 has a plurality of exemplary coupling point pairs 91, 93. Coupling point pair 91 is, in FIG. 2, vertically separated from coupling point pair 93 by a distance of T. A vertical wall beam can have various numbers of coupling points, which can be separated by various distances (e.g., multiples of T). In the embodiment of FIG. 2, each of the pairs of coupling points 91, 93 has been cut into a wall beam 76 using laser cutting techniques, however, other techniques for creating coupling points on a vertical wall beam (such as stamping or punching) may be used in other embodiments. As described above, a pin or bolt may be used to couple a horizontal beam or another component to the vertical wall beams. In this regard, the pin or bolt may be inserted through a hole of first pair of holes 91 or second pair of holes 93. In some embodiments, a coupling point of a vertical wall beam may be threaded to receive a threaded bolt. Further embodiments may use screws (with pre-drilled holes), snaps, inserts, slotting features (male/female), reversible glues, Velcro, or other connectors as appropriate as a coupling mechanism. Still other embodiments may use different, or various combinations, of the mechanisms of coupling points of vertical wall beams described above.

The plurality of vertical wall beams 74 through 80 may be coupled to the horizontal floor beam 82. Horizontal floor beam 82 of FIG. 2 has, in an exemplary embodiment, a depth corresponding to the distance between the floor nodes (described below with respect to FIGS. 10-12B), the center of which nodes are separated by a multiple of U minus the width of ½ of each of the a floor nodes at the end of the horizontal floor beam. The height of a horizontal floor beam may vary, but (as with the roof beam) will be understood to be standardized for fabrication. As with the roof beams, the points of the floor beam that couple to (or are coupled to) the vertical or horizontal wall beam will be understood to have dimensions necessary to conform the floor grid system to the U/T structure. The elements of the floor beam that do not so couple (e.g., the height of the beam) need not specifically follow U/T dimensions. Each of the vertical wall beams 74-80 may be coupled, through a wall beam node, to the horizontal floor beam 82, such as by a plurality of bolts or fasteners passing through the holes of the horizontal floor beam 82 and the corresponding holes on respective ones of the vertical wall beams 74-80. Other techniques for coupling the vertical wall beams 74-80 to the horizontal floor beam 82 may alternatively be implemented, such as those mentioned above.

In a preferred embodiment, the vertical wall beams, horizontal wall beams, roof beams, floor beams, and other railing components of the wall, floor, ceiling, and roof grids are made of steel. However, in alternate embodiments, other materials of sufficient strength and durability may be used, provided such materials can be fabricated with the required practical features for assembly (e.g., laser cut with the appropriate coupling points, or fabricated by any other appropriate method).

FIG. 2 also illustrates a plurality of insulating panels 90, 92, 94, and 96. Each of the insulating panels 90, 92, 94, and 96 is coupled to two vertical wall beams, of beams 74 to 80, via any of a variety of fasteners or connectors, such as pins, bolts, slots, or snap fits, among others. Further embodiments may use screws (with pre-drilled holes), snaps, inserts, slotting features (male/female), magnets, reversible glues, Velcro, or other connectors as appropriate as a coupling mechanism. For example, insulating panel 90 is shown in FIG. 2 to be coupled to a portion of vertical wall beams 76 and 77 and positioned adjacent to insulating panel 92, which is coupled to both vertical wall beams 77 and 78, to cover a desired portion of the exterior of the structure 5. In some embodiments, the insulating panel 92 may be additionally coupled to one or more horizontal beams connected to the vertical beams 77 and 78, to provide additional resistive support to the insulating panel 92. Other insulating panels of the structure 5 may be positioned adjacent to each other in a similar manner. The insulating panels 90, 92, 94 and 96 depicted in FIG. 2 are exemplary, and insulating panels in other embodiments may differ, for example, in their size and position.

In some embodiments, an insulating panel 90 may be fabricated using a lamination process, and can have adjacently stacked layers made of various insulating and/or protective materials. In one embodiment, an insulating panel 90 having a layered structure made of, e.g., polyurethane, insulating foam, and a sheer base material, can be mounted to some components of the modular structure 5, such as a vertical or horizontal wall beam, and mounted on by other components of modular structure 5, such as an exterior cladding panel (described below). In one embodiment, an insulating panel 90 has a sheer face made of a metal or metallic material; however, other materials may be used in other embodiments. The materials making up the interior of the insulating panels comprise, in one embodiment, polyurethane and/or insulating foam, however other materials may be used.

As shown in FIG. 2, each of the insulating panels 90, 92, 94, and 96 has a width of approximately 6T (not accounting for clearance between the panels), but other widths (corresponding to multiples of T) may be used in different embodiments. In addition, embodiments may be possible where the width of the insulating panels 90 may differ between panels coupled to different walls of the structure 5 (or between panels on the same wall). In a preferred embodiment, each of the panels 90, 92, 94, and 96 has an approximately uniform thickness and an approximately uniform width and height (with respect to each other), but other thicknesses and dimensions are possible. As just one example, if one portion of the structure is exposed to an extreme temperature source (such as a heater or direct sunlight), the insulating panel at that portion of the structure may provide more insulation than at other points on the structure. Similarly, it will be understood that the thickness of the insulating panels 90, 92, 94, and 96, and/or the materials used therein, may differ between structures 5 intended to be used in different climates; that is, thicker insulating panels may be used in hotter or colder climates, and thinner ones in more temperate climates. In addition, different materials may be used on the exterior or interior of the insulating panel 90 depending on the conditions of the region in which the structure is intended to be used, for example to withstand storms, to avoid rusting or scratching from environmental hazards, or to meet housing or governmental regulatory standards. As another example, alternate embodiments may use only recyclable and/or biodegradable materials within the insulating panels. In a preferred embodiment, the insulating panels also act as shear wall structure working to provide support for resistance of lateral forces such as wind and seismic loads (resisting transverse loads applied normally to the outside of the structure 5), however, in alternate embodiments, shear walls may be a separate component part of the structure (taking the form of, e.g., cross bracing straps, cross bracing cables, metal sheets, or other resistant/bracing structures). In the preferred embodiment, the exterior wall (sheathing) of the insulating wall serves at least two purposes, permitting attachment of cladding rails (described below) and sealing.

For ease of illustration, panels 90, 92, 94, and 96 are shown in FIG. 2 with a shorter height than the panels otherwise might have (that is, shorter than the entire height of the structure 5), and it will be understood that the insulating panels of the structure 5 can have various heights, corresponding to multiples of T, to cover a desired portion of the exterior of the structure 5. In this regard, insulating panels 90, 92, 94, and 96 each may have a height that generally corresponds to a desired height for the insulating panel relative to features of the structure, such as windows, doors, or other features, so that, in some embodiments, the panels have heights that differ from each other.

In addition, each of the insulating panels 90, 92, 94, and 96 has a plurality of holes for receiving fasteners, such as pins, bolts, or snap fits, among other types of connectors. Further embodiments may use screws (with pre-drilled holes), snaps, inserts, slotting features (male/female), magnets, reversible glues, Velcro, or other connectors as appropriate as a coupling mechanism. In some embodiments, the holes may be positioned on the external face of an insulating panel. The holes of an insulating panel may be threaded or otherwise configured to receive a fastener such as a pin, bolt, or snap-fit connector, or any of a variety of types of connectors. Exemplary hole 100 (illustrated in FIG. 2 at the upper-rightmost corner of insulating panel 90) is positioned on an exterior face of panel 90 and is configured to receive a bolt fastener, such as may be used to couple one of horizontal exterior cladding rails 105, 107 or 109 to an insulating panel 90.

The horizontal exterior cladding rails 105, 107, 109 illustrated in FIG. 2 are exemplary, and other rails of the structure 5 may have various other features, dimensions, or functionality to achieve the functionality described herein. Each of the horizontal exterior cladding rails 105, 107, and 109 is configured to receive a bracket or connector mounted to the exterior cladding panel, such as exterior cladding panels 120, 122, and 124, which form an outward-facing wall of the structure. Exterior cladding rails 105, 107, and 109 may have various dimensions, but may have, in one embodiment, widths equal to a respective multiple of T. In addition, although the exterior cladding rails 105, 107, and 109 may be separated from each other by various distances, as in the embodiment of FIG. 2, a vertical distance between a horizontal centerline of an exterior cladding rail and a horizontal centerline of another exterior cladding rail corresponds to a multiple of T. A vertical separation of exterior cladding rails may be based on positions of holes of respective insulating panels to which the cladding rails are coupled, which positions are separated by distances corresponding to a multiple of T (in the illustrated example, 11T). In some embodiments, a plurality of exterior cladding rails may be present to provide needed support for one or more exterior cladding panels. In that case, exterior cladding rails on the structure 5 may be separated by various distances in multiples of T from other exterior cladding rails.

Exterior cladding rails 105, 107, and 109 may be configured to receive a portion of a bracket or connector (not specifically shown in FIG. 2) of an exterior cladding panel, such as panels 120, 122, 124. The portion of the bracket may, in some embodiments, drop into a portion of the exterior cladding rail to couple the exterior cladding panel to the horizontal exterior cladding rail. In a preferred embodiment, the "thickness" of the combination of exterior cladding panel, the exterior cladding rail, and the insulating panel together is approximately one half of the width of the vertical wall beam to which the paneling is coupled (about 2T in the illustration of FIG. 2), however, different relative thicknesses may be used in different embodiments (including different relative thicknesses at different portions of the structure 5).

With reference to FIG. 2, the exterior cladding panels may be coupled to exterior cladding rails in a sequence beginning with the lowermost-positioned exterior cladding panel on the portion of the structure 5 where the panels are being installed (e.g., panels 122 and 124 in FIG. 2) and ending with the highest-positioned exterior cladding panel (e.g., panel 120 in FIG. 2). For example, before exterior cladding panel 120 can be installed by coupling its bracket into a portion of horizontal exterior cladding rail 105, exterior cladding panel 122 must first be installed by dropping a portion of its bracket into horizontal exterior cladding rail 109. Thereafter, a portion of the bracket coupled to exterior cladding panel 120 may be dropped into the horizontal exterior cladding rail. Other exterior cladding panels and horizontal exterior cladding rails may be configured similarly.

Although exterior cladding panels 120-124 are depicted as being arranged in a stacked bond pattern, the exterior cladding panels (and other cladding or insulating panels of the structure 5) may in some embodiments be arranged in various patterns, such as having a running bond or stacked bond pattern, or in multiple patterns on the same structure.

An exterior cladding panel may, in some embodiments, have a width of T or of a multiple of T. Additionally, in some embodiments, an exterior cladding panel may have a height that is approximately equal to ½ of the height of the structure 5, however, any multiple of T (that allows for a whole number of panels to fit vertically into the structure) may be used. It will be noted that, regardless of whether an exterior cladding panel is positioned on the structure 5 to be above or below a feature such as a window 30, 32, 40 or a door 42, 44 (FIG. 1), or whether the exterior cladding panel is a part of the wall of the structure where no such features present, the height of the panel is, in the preferred embodiment, a multiple of T. In some embodiments, the width and/or height of the exterior panels will be approximately a multiple of T, so as to account for clearance between the panels. In a manner similar to that of the insulating panels, it will be understood that the number of multiples of T for the width and/or height of the exterior cladding panel may be chosen so as to allow a whole number of panels to fit within the dimensions of the area intended to be covered by the exterior cladding panels, without any need for cutting, shaping, or other customization of the size of the panels. In some embodiments, the entirety of the area of the insulating panels is covered by exterior cladding panels, in which case, such dimensions may include the height of the structure 5 at the particular portion of the structure 5 at which the panel is to be placed. In another, alternative embodiment, the panels may be arranged in a manner that does not cover the entirety of the width, depth, and/or height of the structure 5, e.g., when aesthetic, regulatory, or weatherproofing reasons may limit the number of panels that may be attached. In such circumstances, at the points where the exterior cladding panels are not applied, insulating panels 90, 92, 94, and 96 may act, in whole or in part, as the exterior (outermost) surface of the modular structure 5.

In a preferred embodiment, the exterior cladding panels may be removed by disassembling the arrangement of the panels in a reverse order. For example, when the exterior cladding panels 120-124 are in a stacked bond pattern, the exterior cladding panels located toward the top of the structure may need to be removed before those on the bottom may be removed. By these means, removal of the most-easily accessible panels (those at a lower level) would require a non-trivial effort, and would therefore be difficult or impracticable for an unauthorized person at the ground level of an exterior of the structure 5. Alternate embodiments which have different arrangements of the exterior cladding panels may have similar limitations, and/or may use other mechanisms to lock or fix the exterior cladding panels into place. For example, in some embodiments, the exterior cladding panels 120, 122, and 124 may be additionally or alternately configured to couple to each other (e.g., through a snap, latch, or other type of coupling) so that they are snugly fitted in position adjacent to one or more other panels. Further embodiments may use screws (with pre-drilled holes), snaps, inserts, slotting features (male/female), magnets, reversible glues, Velcro, or other connectors as appropriate as a coupling mechanism. In some embodiments, the exterior cladding panels are configured together in a secure manner such that they cannot be independently removed from the outside of the structure. In yet another embodiment, the exterior cladding panels may be attached to the modular structure 5 via a direct or indirect connection to one or more insulating panels 90, 92, 94, and 96.

The exterior cladding panels of the structure 5 may be, in some embodiments, designed with various externally-facing materials of various colors, patterns and/or textures. For example, the exterior cladding panels 90-94 may be made of wood, brick, or other materials (or designed to simulate such materials), to match an aesthetic design intended for the structure 5. In this manner, the structure 5 may be conformed in style to the owner's preference, neighboring houses or architecture, and/or community standards.

Note that, in the cutaway view shown in FIG. 2, various interior cladding rails 114, 116, and 118 are coupled to an interior side of each of the vertical wall beams 76, 77, 78, 79, and 80. The horizontal interior cladding rails 114, 116, and 118 may be coupled to coupling points on an interior side of each of the vertical wall beams 76 through 80 that are similar to the coupling point pairs 92 and 93 on the exterior sides of each of the vertical wall beams 76-80. As described further below, the horizontal interior cladding rails 114, 116, and 118 may be configured to couple to interior cladding panels (not specifically shown in FIG. 2). Each of the interior cladding rails 114, 116, and 118 may have a width of approximately 6T in the illustrated embodiment, but other widths may be used in other embodiments. In some embodiments, a depth (x-direction) of an interior horizontal cladding rail may correspond to a depth of a section of a wall of the structure 5. In this regard, the horizontal interior cladding rail can couple to adjacent coupling points on interior sides of beams 76-80, and can provide coupling points for one or more interior cladding panels.

FIG. 2 also depicts a floor insulation panel 128 for providing insulation below a floor of the structure 5. One or more floor insulation panels may be installed beneath the entirety or a portion of the structure 5. A floor insulation panel 128 may be configured to have various dimensions within the two-unit system. In some embodiments, a floor insulation panel 128 may have dimensions that generally correspond to a width and depth of a portion of structure 5 for which it has been installed. In FIG. 2, the floor insulation panel 128 has a width and depth that, allowing for necessary clearances between panels, has dimensions that correspond to respective multiples of T. The thickness of the floor panels need not be a multiple of U or T, and instead may vary (though it may still follow a standardized size for fabrication) based on the insulation needs of the environment in which the structure 5 is installed, and whether any additional floor support is necessary, among other factors and has a thickness of T. The thickness of the floor insulation panels is, however, restricted by the amount of space between the floor beams 82 and the ground. Other floor insulation panels may have other dimensions corresponding to the two-unit system in other embodiments.

FIG. 2 has a subfloor panel 130 positioned adjacent to the floor beam 82 and configured to support occupants within the structure. The subfloor panel 130 provides a supportive structure for the floor panels (to be described further below with reference to FIG. 3) A subfloor panel 130 may be configured to have various dimensions in T corresponding to the respective multiples of U set by the floor grid 330 (as shown in FIG. 4), allowing for necessary clearances. In one embodiment, where U=6T, the dimensions of the subfloor panels may be (1×6T)×(2×6T), that is 6T×12T or (2×6T)×(3×6T), that is, 12T×18T, however, different embodiments may have different sizing. In the embodiment of FIG. 2, subfloor panel 130 has a thickness that may vary (though still following a standardized size for fabrication) to provide sufficient support based on the installation needs of the structure 5 (for example, a structure housing heavy equipment or machinery may need a different supportive base than a family dwelling).

The illustration of FIG. 2 also includes a subceiling panel 132 at the top of modular structure 5, which panel is responsible for bearing the weight of ceiling cladding panels (not specifically shown in FIG. 2), along with the roof beams, which are structurally bracing. Subceiling panel 132 is designed with dimensions in T corresponding to the respective multiples of U set by the roof grid 300 (as shown in FIG. 4), in a manner similar to subfloor panel 130. The subceiling panel 132 of structure 5 may have a variable (though standardized) thickness and a depth and width measured as a multiple of T (minus any allowance for clearance between panels).

In a manner similar to that described above with respect to the exterior cladding panels and roof panels, in the preferred embodiment, the numbers of multiples of T for the depth and width of the subfloor panels and the subceiling panels are chosen so as to allow a respective whole number of subfloor panels and whole number of subceiling panels to fit within the U-dimensions of the floor grid and roof grid of the structure 5 (that is, e.g., by the placement of the vertical and horizontal wall beams), without any need for cutting, sanding, shaping, or other customization of the size of any particular panels. Other dimensions of the subfloor panels 130 and the subceiling panels 132 may be possible in other embodiments.

Height-adjustable foundation columns 150, 152, 154, and 156 may be used to support the wall 70 and the floor as shown in FIG. 2, and to provide anchorage to the ground when used with piles. In other embodiments, rather than height-adjustable foundation columns 150, 152, 154, and 156, the structure 5 may instead be designed to tie into an existing foundational structure. FIG. 2 illustrates four height-adjustable foundation columns 150, 152, 154, and 156, but any number of height foundation columns may be possible in alternate embodiments. For example, the size and configuration of the structure 5, the weight of the structure and the expected contents, environmental conditions including the material composition of the ground on which structure 5 is located, the layout and stability of that ground, the expected weather conditions, and other factors may dictate the number of height-adjustable foundation columns needed to provide support for the structure 5. These columns may be located in positions to support the remaining walls 70 of the structure 5, and may, in some embodiments, be placed under the floor beams of the structure 5 at additional interior points.

An exemplary height-adjustable foundation column 150 has a base plate 160 and a threaded tube 162 which can be used to support a threaded column 164. A height of the height-adjustable foundation column 150 changes as threaded column 164 rotates within the threaded tube. In this regard, a height of the height-adjustable foundation column 150 may be changed by rotating the threaded column 164 within the threaded tube 162 to increase or decrease a distance between the ground and a bottom surface of horizontal floor beam 82. A height-adjustable foundation column 150 may have additional features in other embodiments. The height of any particular height-adjustable foundation column 150 may be changed to raise or lower a portion of a floor beam 82 (and thus, all or a portion of the structure 5) as desired, such as in order to achieve a desired leveling for the structure 5 if, e.g., the structure is installed on uneven ground. In other embodiments, the foundation is also laterally-adjustable, to accommodate offsets in pile installation. In still other possible embodiments, rather than a base plate and column, the threaded portion of the height-adjustable foundation column 150 will thread into a pile cap mounted to a helical pile.

Figure 3:
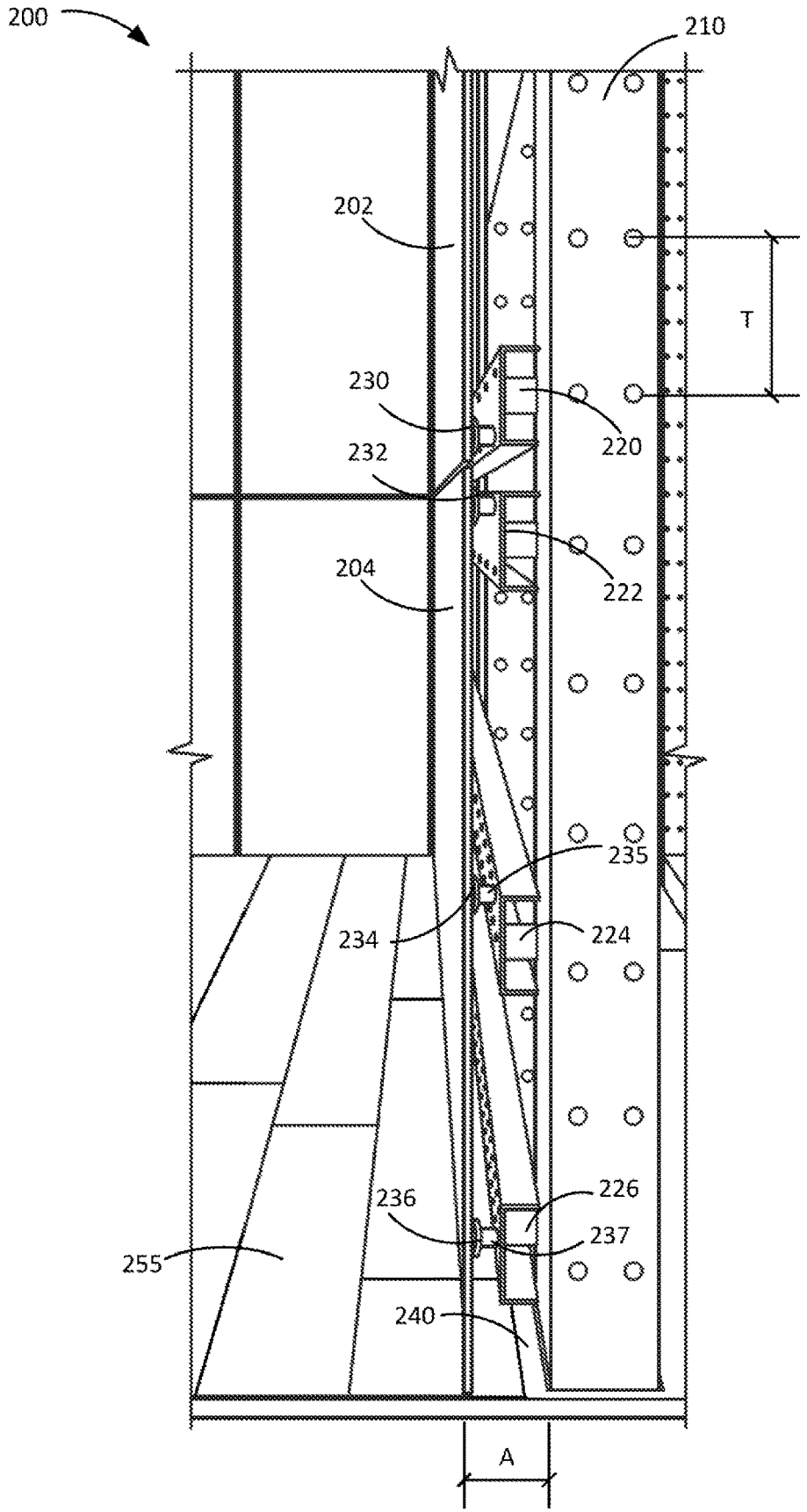
FIG. 3 depicts a cross-sectional view of a wall of a reusable modular dwelling system in accordance with some embodiments of the present disclosure.

FIG. 3 shows a cross-sectional view of a wall 200 of a modular structure 5 in accordance with some embodiments of the present disclosure. The wall 200 of FIG. 3 has an interior cladding panel 202, an interior cladding panel 204, and a vertical wall beam 210. Horizontal interior cladding rails are coupled to the vertical wall beam 210 at coupling points on the beam. The vertical wall beam 210 has a plurality of interior cladding rails 220, 222, 224 and 226 coupled to an interior side of the vertical wall beam 210 at a plurality of coupling points of the beam 210. In some embodiments, the coupling may be performed via a plurality of pins that pass through holes of an interior cladding rail and through the corresponding holes (coupling points) of a vertical wall beam. Other types of fasteners may be used in other embodiments. With reference to FIG. 3, a plurality of pins couple the interior cladding rails 220, 222, 224 and 226 to the vertical wall beam 210 by passing through holes of the rails 220, 222, 224, and 226 and coupling points of the vertical wall beam 210. Alternately, the railings could be inserted (via hooks or projections) into slots pre-cut into the vertical wall beam, so as not to use pins.

In FIG. 3, a plurality of exemplary interior cladding panels 202, 204 are coupled to the interior cladding rails 220, 222, 224 and 226. An interior cladding panel 202, 204 may have dimensions corresponding to the two-unit system, that is, the panel may have a width and height corresponding to respective multiples of T. In a manner similar to that described above with respect to the width of the exterior, roof, and floor, panels, in the preferred embodiment, the respective numbers of multiples of T for the height of depth and width of the interior cladding panels are chosen so as to allow a whole number of interior cladding panels to fit within the U/T dimensions defined by the width, depth, and height of the structure (that is, the placement of the vertical and horizontal wall beams, and the floor and ceiling beams), without any need for cutting, sanding, shaping, or other customization of the size of the panels.

An interior cladding panel may be made of a variety of materials, with different colors, textures, and finishes, to achieve a desired aesthetic or functionality. For example, interior cladding panels in certain portions of the structure 5 may require materials resistant to exposure to greater heat or moisture (for example, in a kitchen or shower area), or may need to be of a material that can be modified for access to utility ports and interfaces (e.g., LCD or touchscreen panels for utilization of smart features inside the home). In some embodiments, the interior cladding may also contain openings for one or more interfaces through which utilities such as electricity, data, HVAC, sewage, temperature, security, etc., may be controlled. These interfaces may make up a comprehensive smart home system, or customizable/selectable smart features. For example, the smart interfaces may include temperature and lighting control, speakers (for music, sounds, or doorbells), sensors (including protective detection like fire or $CO_2$ detection), assistive technology, computer telephony, and/or other data connectivity to smart phones, tablets, personal computers, virtual assistants, appliances, or security systems, among many other possibilities. The structure of the interior cladding may, in a preferred embodiment, act as the skeleton or framework into which data-enabled interfaces are installed. In one embodiment, the interior cladding panels are structured so as to border a single interface for controlling all such utilities, but multiple interfaces may also be used. In another embodiment, an interface for controlling such utilities may be built into a customized face of one or more interior cladding panels, for example, as a touchscreen. In alternate embodiments, such interfaces may be placed behind the interior cladding panels, accessible upon removal of the panel; such solutions being most effective for utilities that require less frequent access.

An interior cladding panel of the structure 5 also may have one or more fasteners for insertion into a hole of an interior cladding rail, or into a hole of a vertical wall beam. In one embodiment, the interior cladding panels may connect to an interior cladding rail (or, in some embodiments, to the horizontal or vertical beams) via a snap fit connector that can be mated and separated. For example, a male or female portion of a snap fit connection located on the interior cladding panel may be attached to a corresponding portion of the snap fit connection on the railing through a pressing together of the corresponding portions. The snap fit connection may then be disengaged by a pulling, or an unlocking of the connection. In the embodiment of FIG. 3, panel 202 has a snap 230 which has been snapped into rail 220. The snap 230 can be detached from the rail 220 in order to allow interior cladding panel 202 to be removed, such as when access to space behind the interior cladding panel 202 is desired or when the structure 5 is disassembled. The snap 230 can be later be reattached to the rail 220. In alternate embodiments, other types of removable connections, including pins, clips, etc. may be used. Further embodiments may use screws (with pre-drilled holes), snaps, inserts, slotting features (male/female), magnets, reversible glues, Velcro, or other connectors as appropriate as a coupling mechanism. By these means, in contrast to the exterior cladding panels, the interior panels can be easily removed and replaced, with minimal effort, in order to change or remove panels, or to access interior utility ports, among other reasons. It will be understood that, like the other components of the modular structure 5, the interior cladding panels may be coupled and uncoupled without damage or physical or structural alteration to the interior cladding panels or their respective connections on the horizontal and/or vertical beams.

In an exemplary installation, in a manner similar to that described above, exemplary interior cladding panel 204 is coupled to interior cladding rails 222, 224, and 226 by snaps 232, 234, and 236 (FIG. 3). Any of the snaps 230, 232, 234, and 236 can be disengaged from its mated portion on respective interior cladding rails 220, 222, 224, and 226 to allow removal of panel 204, and can be reinserted when reinstallation of panel 204 is desired. In the embodiment of FIG. 3, each of interior cladding panels 202 and 204 has approximately 8 snaps, although only snaps 230, 232, 234, and 236 are illustrated. It will be understood that, although a particular number of panels, snaps, and horizontal interior cladding rails are shown in FIG. 3, any of a variety of numbers of such components are possible in other embodiments.

Elements 230, 232, 234, and 236 of FIG. 3 indicate an end of a snap-fit connector that is attached to the interior cladding panels. Each of these snap fit connectors also has an opposite (mating) end attached to the respective interior cladding rail to which the panel is to be connected. The opposite end of the snaps 234 and 236 are labeled as 235 and 237, respectively. The length of the snap ends 235 and 237 may vary in size dependent on the thickness of the interior cladding panel. In particular, the totality of the distance from the cosmetic interior face of the interior cladding panel to the vertical wall beam (marked by distance A on FIG. 3) should be a value in a multiple of T (typically 1T in a preferred embodiment), and the length of the snap ends 235 and 237 may, in one embodiment, be adjusted to accommodate such sizing.

As mentioned above with respect to FIG. 2, the spacing between longitudinal centerlines of adjacent horizontal interior cladding rails (e.g., rails 220, 222, 224, and 226) may correspond to a multiple of T. For example, in FIG. 3, a distance between a centerline of horizontal interior cladding rail 220 and a centerline of horizontal interior cladding rail 222 is 1T. A distance between the centerline of rail 222 and a centerline of rail 224 is also a multiple of T, e.g., 4T. In some embodiments, a vertical distance between each horizontal interior cladding rail (as measured from a centerline of each respective rail) corresponds to a multiple of T.

In some embodiments, cabinetry, bookcases, countertops, seating, folding beds, decorative components, or other features may also be integrated into the interior architecture in a manner similar to that of the interior cladding, that is, in dimensions corresponding to a T-sizing and with coupling points to the cladding rails and/or vertical wall beams. As one example, a cabinetry structure that conforms to a width and a height of respective multiples of T may be attached to the interior cladding rails in a manner similar to that of the interior cladding panels (that is, by snap fit, slots, pins, magnets, or any other of the aforementioned connectors). The depth of the exemplary cabinet may be of any practicable size for the room, assuming the structure can support the same, and need not conform to a multiple of U or T. By these means, the interior of the structure 5 can be customized not just on the face of the walls, but through the incorporation of three-dimensional functional furniture and add-ons that can be used by the occupant into the structure of the building itself. Such incorporation may also help to support the add-on structures (like furniture or bookcases) so as to, for example, reduce the amount of weight placed on the flooring system, and provide stability on uneven terrain or in earthquake-prone environments.

Also illustrated in FIG. 3 is an exemplary floor panel 255. The floor panel 255 may be configured to remain in place on top of both a portion of one or more floor beams 82 and a sub floor panel 130 (FIG. 2). While only one floor panel 255 is labeled in FIG. 3, other floor panels may be understood to be similar to floor panel 255. For example, floor panel 255 may be, in one embodiment, configured for use with a system of tongue-in-groove floor panels. In this regard, floor panel 255 may be configured to have a tongue-in-groove pattern on one or more of its edges and may be configured to fit together with one or more adjacent floor panels as in a tongue-in-groove flooring system. As another example, a floor panel may be configured for placement adjacent to one or more vertical wall beams. In this regard, an exemplary floor panel may have one or more notches for fitting around the one or more vertical wall beams. A shape of a notch may correspond to a cross-sectional shape of the vertical wall beam. When such a floor panel is laid in position, the floor panel may be fitted to adjacent tongue-in-groove floor panels and have one or more vertical wall beams within one or more of its notches, thereby securing the floor panel in place. In the example of FIG. 3, the illustrated floor panel 255 has an exemplary notch 240 which has dimensions that allow it to fit around vertical wall beam 210 when floor panel 255 is in position (e.g., placed on a portion of floor beam 82).

Floor panels that are intended to be positioned adjacent to a wall of the structure 5 (e.g., below and adjacent to interior cladding panels and vertical wall beams) may be configured to extend beyond a point where a plane defined by surfaces of adjacent interior cladding panels and a plane defined by the surface of the floor panel intersect, and to terminate at a point that is between the interior cladding panel and an insulating panel (e.g., within the wall of the structure 5). To illustrate, with reference to FIG. 3, a portion of floor panel 255 extends under interior cladding panel 204 and terminates between the interior cladding panel 204 and a position of an insulating panel (not specifically shown in FIG. 3) such as may be coupled to an exterior side of the vertical wall beam 210. As a result of such a configuration, an edge of the flooring panel 255 may be obscured from view once the structure has been assembled.

To further illustrate an exemplary configuration of the reusable modular structure 5, FIGS. 4-12B depict various components of the structure 5 in accordance with some embodiments of the present disclosure. As noted above, it will be understood that each component of the structure 5 has dimensions and/or is positioned at locations on the structure in a manner consistent with and corresponding to the two-unit U and T system described above, although other numbers of units and variations on dimensions ascribed to each component and its respective assemblies may be possible in other embodiments. In addition, it will be appreciated that structure 5 is an exemplary structure that is part of a reusable modular dwelling system, and is thus capable of being repeatedly assembled, disassembled, and reassembled (or alternately assembled into a changed configuration).

In a preferred implementation, the described components of the modular structure 5 are made of highly-durable materials, such that the materials remain in a usable condition after the use-life of the modular structure. That is, at a point that the structure 5 is no longer needed as configured (e.g., if the capacity needs of the property have changed and the structure should be relocated, removed, or replaced), each component part of the structure is in good enough of a condition that it could be reused in a different structure having the same or an alternate configuration to the structure 5. Due to the manner of connection and the standardization of dimensions of the component parts described above, the disassembly of the structure 5 places little or no strain on the parts of the structure as a whole. In this manner, the structure can be disassembled without damage or waste of any material components parts. By these means, each component (or virtually all components) of the structure 5 is reusable, and can be recycled, reconditioned, repaired, and/or reused.

FIG. 4 depicts an alternative view of modular structure 5 in accordance with some embodiments of the present disclosure. The embodiment in FIG. 4 is substantially similar to the embodiments of FIGS. 1-3, however, the exterior cladding, insulating panels (on walls and floor), the interior panels, and other components have been removed to better show the elements of the roof beam grid 300, wall beam frame 320, and floor support grid 330. As can be seen in FIG. 4, at least a portion of the wall beams of the wall beam frame 320 are oriented substantially orthogonally to each of the roof beam grid 300 and floor support grid 330. Each component of roof beam grid 300, wall beam frame 320, and floor support grid 330 has dimensions corresponding to the two-unit system of system. The vertical wall beams of the wall beam frame 320 connect the roof beam grid 300 to the floor support grid 330. As described in greater detail below with reference to FIGS. 7A and 7B and FIGS. 12A and 12B, each of the vertical wall beams may couple to the roof and floor grids through the use of fasteners such as pins or bolts passed through holes of the vertical wall beams and through corresponding holes of receptacles attached to floor or roof nodes. Adjacent beams of the wall beam frame 320 (that is, beams that "connect" to each other in the wall beam frame 320 may be similarly attached to different receptacles on the same floor or roof node, through the use of fasteners such as pins or bolts passed through holes of the beam and through corresponding holes of receptacles. In the case of some interior beams in the roof grid 300 or the floor grid 330, those beams may, in some embodiments, connect directly to perimeter beams (through, e.g., pins or bolts) without the use of a roof or floor node.

The modular structure 5 of FIG. 4 may, in some embodiments, have doors 42 and 44, shown with a width of approximately 12T each (corresponding to a distance 2U between vertical beams of the wall grid), not accounting for the size of the framing, among other things, and a height that is less than the height of the wall beams of the wall beam frame 320. A window 336 is positioned opposite to window 30 (window 336 being shown with a width of approximately 12T (corresponding to a distance 2U between vertical beams of the wall grid)). A window 338 is positioned opposite window 32 (window 338 being shown a width of approximately 18T (corresponding to a distance 3U between vertical beams of the wall grid)). In the illustrated embodiment, each of the windows 30 and 32 has a height that is a multiple of T, such height being less than the multiple of T of adjacent beams of wall beam frame 320. It will be understood that the above-described dimensions are exemplary, and other dimensions may be used in other embodiments.

In some embodiments, the structure 5 may have interior door frames. With reference to FIG. 4, horizontal door frame beams 340 and 342 (also shown in FIG. 8) may be configured to have desired dimensions (in a preferred embodiment, where 1U=6T, the dimensions would be a width of approximately 6T or 12T and a height equal to a multiple of T, not accounting for the size of any framing) and to define an uppermost side of a doorway providing access between rooms 12 and 14. Similarly, horizontal door frame beams with desired dimensions similar to those of beams 340 and 342 (shown as horizontal door frame beams 344 and 346 in FIG. 8), may be arranged to define an uppermost side of a doorway between rooms 10 and 12. Each of the beams 340, 342, 344 and 346 (shown in FIG. 8) may couple to vertical wall beams of the wall beam frame 320 through the use of fasteners such as pins or bolts passed through holes of the beams 340, 342, 344 and 346 and through corresponding holes of the vertical wall beams. Other configurations of the door beams of the structure 5 are possible in other embodiments.

FIG. 4 also depicts a roof beam grid 300 and a floor beam grid 330 (respectively described in greater detail below). In a preferred embodiment, the wall beams, roof beams, and floor beams may vary in their gauge (material thickness) at different points in the structure 5 to provide proper force distribution. For example, beams that are located next to windows, doors, porches, and other entry points experience more load than average beams, and therefore would have a lower gauge (i.e., larger in thickness), so as to be stronger than other, standard gauges and provide additional support. In one embodiment, gauges of sizes 14, 11, and 9 (strongest) may be used for standard beams, beams next to the window, and beams next to a door or porch, respectively, though other sized beams may be used in different embodiments. While similarly-sized beams are used in the illustrated embodiment, in some embodiments floor and/or roof beams may be of different material thicknesses than the wall beams. It will be understood that rather than using the strongest gauged beams at all points, efficiency of material use can be optimized by selecting appropriately-gauged beams. While the beams may differ in thickness, the beams are still designed with coupling points so as to allow creation of a grid following the U and T system.

Figure 5:
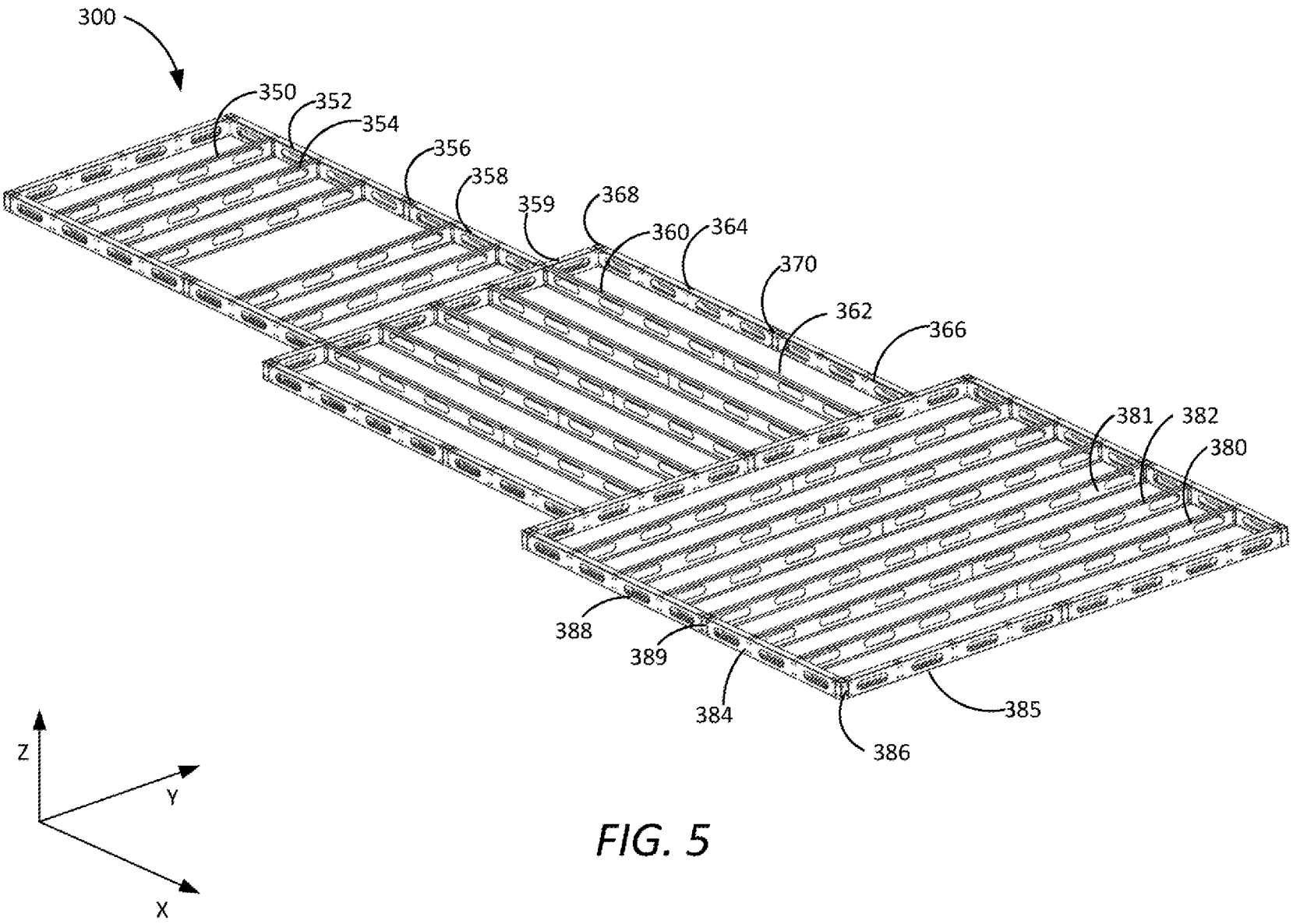
FIG. 5 depicts roof beams of a reusable modular dwelling system in accordance with some embodiments of the present disclosure.

FIG. 5 depicts an alternative view of roof beam grid 300, which comprises a plurality of roof beams similar to exemplary roof beam 72 (shown in FIG. 2). The beams of the roof beam grid 300 have various dimensions selected to permit assembly of the roof beam grid 300 into a desired configuration for the structure 5, which configuration dimensions will impact the placement of the various wall beams of the wall beam frames 320. In a preferred embodiment, the beams of the roof beam grid 300 may have dimensions corresponding to the two-unit system as described herein, however alternate embodiments may be designed with other dimensions.

In some embodiments, the beams of the roof beam grid 300 can be coupled together to achieve desired dimensions for the roof beam grid 300 and the structure 5. In the embodiment shown in FIG. 5, each of interior roof beams 350, 354, 360, 362, 380, 381, 382 may be configured to couple to one or more of perimeter roof beams (e.g., perimeter roof beams 352, 358, 359, 364, 366, 385, 384, 388) via roof nodes 356, 368, 370, 386, and 389 (described in greater detail below). In alternate embodiments, the interior roof beams may couple directly to the perimeter roof beams via pins, bolts, or the like. The beams of the grid 300 may have various configurations depending on whether a particular beam is an interior roof beam or a perimeter roof beam. With reference to FIG. 6, beam 350 is an interior roof beam (or a joist) that has an I-shaped cross-sectional profile. Perimeter roof beams such as beams 352 and 358 (not shown in FIG. 6) may have a substantially rectangular cross-sectional profile (FIG. 5). Other cross-sectional profile shapes for interior beams and perimeter beams of the roof beam grid 300 are possible in other embodiments.

Each of interior roof beams 350 and 354 may be configured to couple to perimeter beam 352 and/or to one or more of the vertical wall beams via a roof node. For example, with reference to FIG. 6, interior roof beam 350 is configured to be coupled to a roof node (which is in turn connected to a perimeter beam), for example by inserting a pin or bolt (or another appropriate coupling mechanism) through one or more of the plurality of holes 402 on end 401 or through one or more of the plurality of holes 404 on end 403, when the beam 350 is positioned so as to be adjacent to one or more corresponding holes on the roof node. In a preferred embodiment, a beam is positioned adjacently to corresponding holes in a roof node by inserting the beam 350 into a receptacle of the roof node (or one attachable thereto), however, in other embodiments, the beam may simply be held in position at the side or in front of the roof node. The perimeter beam 352, 358 is positioned so as to be adjacent to corresponding holes on the same roof node, and is similarly connected thereto by pins or bolts (or another appropriate coupling mechanism). In alternate embodiments (not shown) beam 350 similarly can be coupled to one or more other interior roof beams 360, 362 via a roof node. In another alternate embodiment (not shown), the beams may be directly connected to each other, or to the vertical wall beams, by inserting, e.g., a pin or bolt through one or more of the plurality of holes in the beam when the beam is positioned adjacent into one or more corresponding holes on another beam or a vertical wall beam.

In some embodiments, the roof beam 350 may be positioned substantially orthogonally to a vertical wall beam when coupled to it. However, in alternate embodiments, the roof beam 350 may be arranged at an angle from the vertical wall beam. Roof beam 350 may be configured with holes 414, 416, 418, spaced apart by respective multiples of T, which are used in some embodiments to connect subceiling panels 132 (or other insulation panels) to the roof beams. In addition, the beam 350 may also have lightening holes 406, 408, 410, and 412 for reducing weight of the beam 350. The holes 406, 408, 410, and 412 are illustrated in FIG. 6 as oval-shaped, but other shapes and/or combinations of shapes are possible in alternate embodiments. The height of the roof beam may vary from a multiple of U or T (though the height may be standardized for fabrication so as to be consistent throughout the structure 5), however, it will be understood that the beam is sized so as to allow it to couple to the roof grid in conformance with U/T sizing. In one exemplary embodiment, the height of the roof beam may be 160 mm [6.30 inches]. Beams of the roof beam grid 300 may have dimensions and features similar to those of exemplary beam 350; however, other dimensions and features are possible in other embodiments. In configurations where an interior roof beam is designed to couple between perimeter beams (and/or vertical wall beams) via a roof node, which are separated by a distance of a multiple of U (between the longitudinal center of the roof node), roof beam 350 has a length of a multiple of U−½ room node width−½ roof node width. Therefore, in such embodiments, the beam 350 illustrated in FIGS. 5 and 6 has a length of 8U−½ roof node width−½ roof node width. In configurations where roof beams connect directly to each other (or to vertical wall beams) without the use of roof nodes, the length of beam 650 may be multiple of U−½ roof beam width−½ roof beam width. In alternate embodiments, where the width of the perimeter beams is insignificant, the length of beam 350 may be approximately 8U.

Turning again to FIG. 5, the roof beam grid 300 may have a plurality of roof nodes at each of the intersection points of any two or more beams, such as exemplary roof nodes 356, 368, 370, 386, and 389, for receiving two or more ends of perimeter roof beams and/or vertical wall beams. Although a particular number and configuration of roof nodes is shown in FIG. 5, it will be appreciated that various numbers and configurations of roof nodes can be implemented in alternate embodiments in order to achieve a desired configuration of the roof grid 300 (e.g., that is, a configuration based on design of the structure 5). It will be understood that, although exemplary nodes are identified in FIG. 5 and discussed herein, the roof beam grid 300 may in other embodiments have other nodes that may be configured in various ways to achieve the functionality described herein.

FIGS. 7A and 7B depict views of roof node 368 of a modular dwelling system in accordance with some embodiments of the present disclosure. The node 368 has a height in accordance with the height of a roof beam. In a preferred embodiment, the width and depth dimensions of the roof node 368 are similar to that of the wall beams (FIG. 4), though they are not so limited. In some embodiments, the roof node 368 may have a first receptacle 422 and a second receptacle 420 for receiving respective ends of a first and second roof beam. In a preferred embodiment, the receptacles are separate components that are detachably coupleable to the roof node 368, however, other embodiments are possible where the receptacles are integral with the node. In some embodiments, an opening of the first receptacle 422 may be oriented essentially orthogonally to an opening of the second receptacle 420. Accordingly, a beam that is inserted into the first receptacle 422 can be oriented essentially orthogonally to a beam inserted into the second receptacle 420. As an example, nodes 368 and 386 of FIG. 5 each have receptacles that are oriented at approximately right angles with respect to one another.

As shown in FIGS. 7A and 7B, detachable receptacles 420 and 422 may be coupled to a node 368. Holes 434 may be used to couple receptacle 422 to beam 368, and holes 440 may be used to couple receptacle 420 to node 368. Other receptacles (not shown) may couple to the node 368 through holes 432 and/or 442. A receptacle, when attached to a node, provides an opening to connect the node to one or more roof beams. Up to four receptacles can be attached, oriented at degrees of essentially 90° relative to one another (one on each of four sides). As another example, nodes 356, 370, and 389 of FIG. 5 may have receptacles with openings positioned approximately 180° relative to one another. In some embodiments, openings of receptacles of roof nodes may be oriented at other angles, such as when such orientation is required to achieve a desired configuration for a roof beam grid 300 of structure 5.

As described above, the roof node 368 of FIGS. 7A and 7B may be configured to receive an end of a first perimeter roof beam 359 and an end of second perimeter roof beam 364. In the embodiment of FIG. 5, an end of first beam 359 is inserted into receptacle 422, and an end of second beam 364 is inserted into receptacle 420. When the end of first beam 359 is inserted into receptacle 422, pins or bolts may pass through one or more holes of the first beam 359 and one or more of holes 436 and 438 of receptacle 422 to couple the end of beam 359 to the node 368. When the end of second beam 364 is inserted into receptacle 420, pins or bolts may pass through one or more holes of the second beam 364 and through one or more of the plurality of holes 446 and 448 of receptacle 420 to couple the end of beam 364 to the node 368. An end of a vertical wall beam (FIG. 9) may be inserted into tube opening 426, and pins or bolts inserted into one or more holes 430 to couple the vertical wall beam to the node 368.

Node 386, shown in FIG. 5, has receptacles that are oriented similarly to those of node 368 (e.g., approximately orthogonally), and are configured to receive and couple to an end of perimeter beam 384 and an end of perimeter beam 385. Similarly, node 370 is configured to receive an end of perimeter beam 366 and an end of perimeter beam 364. The receptacles of node 370 are positioned such that their openings are oriented at approximately 180° from one another. Node 389 is configured to receive an end of perimeter beam 388 and an end of perimeter beam 384. The receptacles of node 389 are also positioned such that their openings are oriented at approximately 180° from one another. In one embodiment, in addition to perimeter beams 384 and 388, a third receptacle configured to hold interior beam 381 may be attached to node 389.

With reference to FIG. 5, and as described above, a roof beam is designed to be of a length that separates the centers of roof nodes. For example, as illustrated, the respective center lines of roof nodes 386 and 389 are separated by a distance of 3U (1800 mm [70.87 inches], where U=600 mm [23.62 inches]), corresponding to the horizontal spacing of the vertical wall beams that fit into those roof nodes. The perimeter roof beam 384 that connects those two nodes therefore has a length of 3U−½ node 386 width−½ node 389 width, bridging the distance between the centers of the nodes. In the illustrated embodiment, the width of a roof node is 80 mm [3.15 inches] (though other embodiments may have different sizes), therefore, the length of roof beam 384 is: 1800 mm [70.87 inches]−40 mm [1.57 inches]−40 mm [1.57 inches]=1720 mm [67.72 inches]. Roof beams located at different portions of the structure 5 may be differently sized to accommodate different stresses; for example, beams at the sides of the structure, or near windows or doors, may require additional support. Therefore, in some embodiments, the width, depth, height, or thickness of room beams 384 may change at different parts of the structure 5, provided that the particular dimensions of the beams are still designed to accommodate the U-sized dimensions set out by the roof nodes (FIG. 5).

Figure 8:
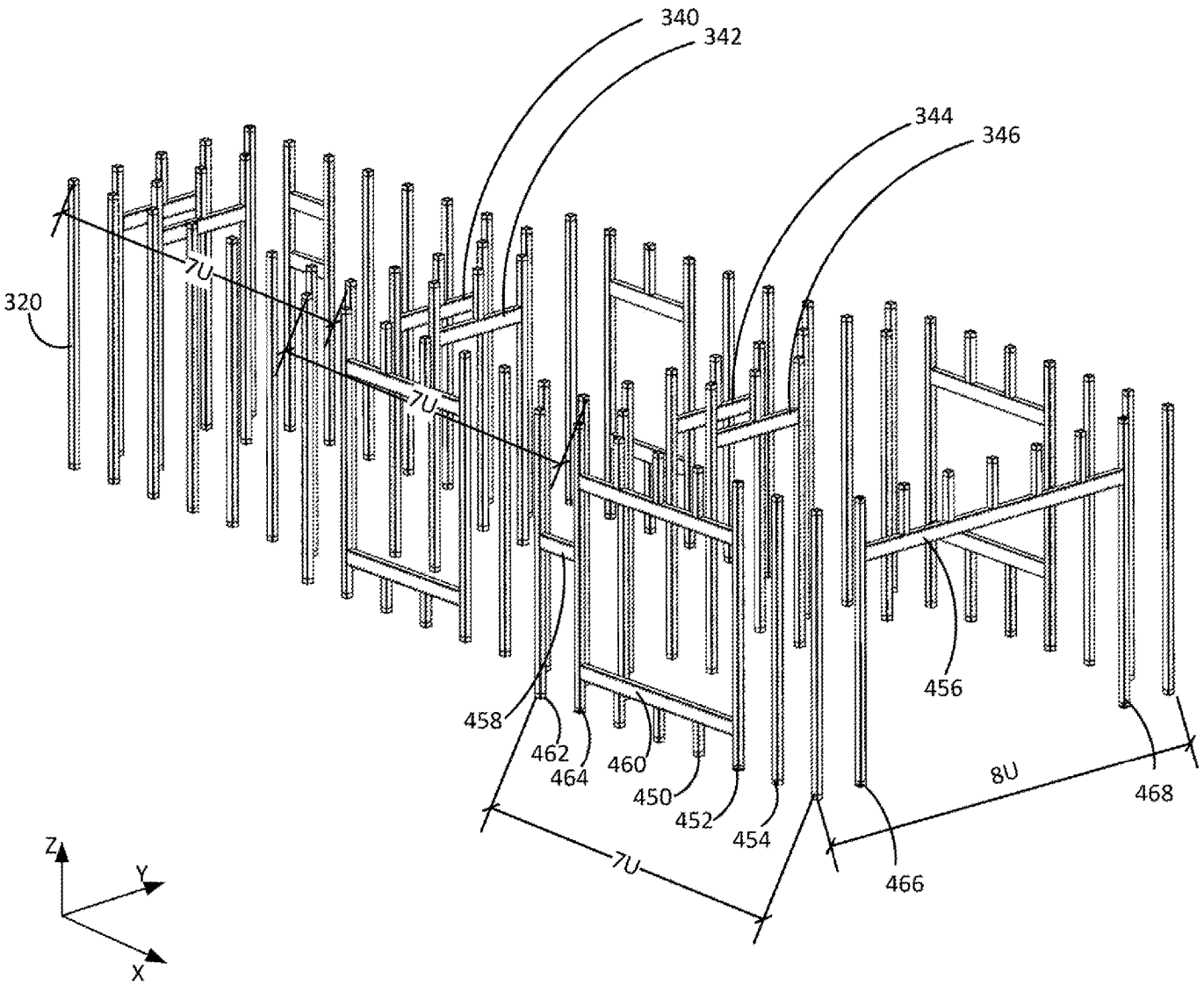
FIG. 8 depicts wall beams of a reusable modular dwelling system in accordance with some embodiments of the present disclosure.

FIG. 8 depicts an additional view of wall beam frame 320 (FIG. 4) in accordance with some embodiments of the present disclosure. The exemplary wall beam frame 320 is essentially the same as the wall beam frame 320 illustrated in FIG. 4. Wall beam frame 320 may have one or more exemplary vertical and horizontal wall beams, such as vertical wall beams 450, 452, 454, 462, 464, 466, and 468 and horizontal beams 456, 458, and 460. The wall beam frame 320 may have other wall beams in other embodiments. Wall beams 450, 452, 454, 462, 464, 466, and 468 are vertical wall beams separated from each other (that is, from an adjacent vertical wall beam) by a distance corresponding to a multiple of U. Wall beams 452, 454, 462, 464, 466, and 468 have approximately the same height, however, wall beam 450 has a shorter height and is coupled to a horizontal lower window beam 460.

Beams 456, 458, and 460 are horizontal beams each coupled to two vertical wall beams, however, in other embodiments, the horizontal beams may be coupled to one vertical beam or three or more vertical beams. In the illustration of FIG. 8, horizontal beam 458 is coupled to wall beams 462 and 464 (via coupling using pins or bolts, or the like, at attachment points of beams 462 and 464). In the illustrated embodiment, horizontal beam 458 has a depth (x-axis) of 1U, and a height (z-axis) that is a multiple of T (e.g., 1T). The horizontal beams 456, 458, and 460 provide support for openings in the structure, acting as, for example, header and footer beams for windows and/or doors. For example, horizontal beam 456 is coupled to beams 466 and 468, and provides stability to a portion of the wall beam frame, in addition to supporting additional components such as porch 38, doors 42 and 44, and window 40 (shown in FIG. 1). Of course, various other dimensions may be used in other embodiments.

Figure 9:
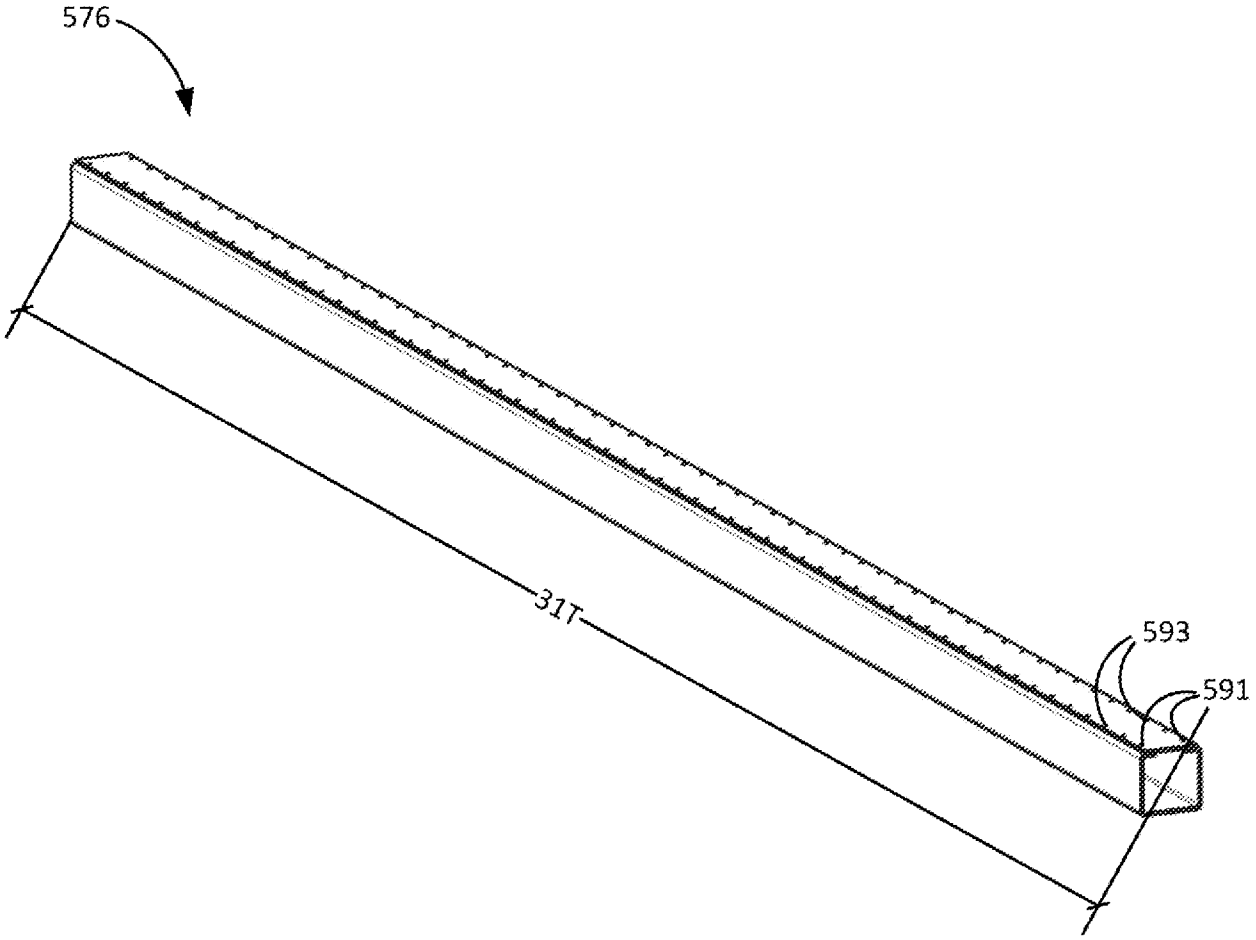
FIG. 9 depicts a wall beam of a reusable modular dwelling system in accordance with some embodiments of the present disclosure.

FIG. 9 depicts an exemplary vertical wall beam 576. The beam 576 is similar to the wall beams shown in FIGS. 2-4. The beam 576 has a plurality of exemplary attachment points such as hole pair 591 and hole pair 593. The attachment points shown in FIG. 9 are similar to those attachment points described above with regard to FIGS. 2-3. As an example, based on the illustration of FIG. 9, the beam 576 may have a height (z-axis) of approximately 31T. The width (y-axis) and depth (x-axis) of the vertical wall beam may be variable (though standard), and in a preferred embodiment, may equal 80 mm [3.15 inches], though other widths and depths are possible. Additionally, as described above, the dimensions of vertical wall beams may differ in different parts of the structure 5 to accommodate any additional support needed at the sides of the structure and/or near windows and doors. A horizontal beam can have similar dimensions to a vertical wall beam, but in some embodiments, it is possible for the horizontal beam (e.g., 456, 458 and 460 in FIG. 8) to have a height that is greater than a depth (x-axis) of a vertical wall beam. More particularly, as described above with respect to roof beams, vertical wall beams are designed to be of a height that connects the centers of the roof and/or floor nodes to which the vertical wall beams connect. A vertical wall beam may therefore have an actual height of a multiple of T−½ roof node width−½ floor node width, to bridge the distance between the centers of the nodes. In some embodiments, dimensions of the vertical or horizontal wall beams can vary based on design of the structure 5, but remain in correspondence with the two-unit system.

Figure 10:
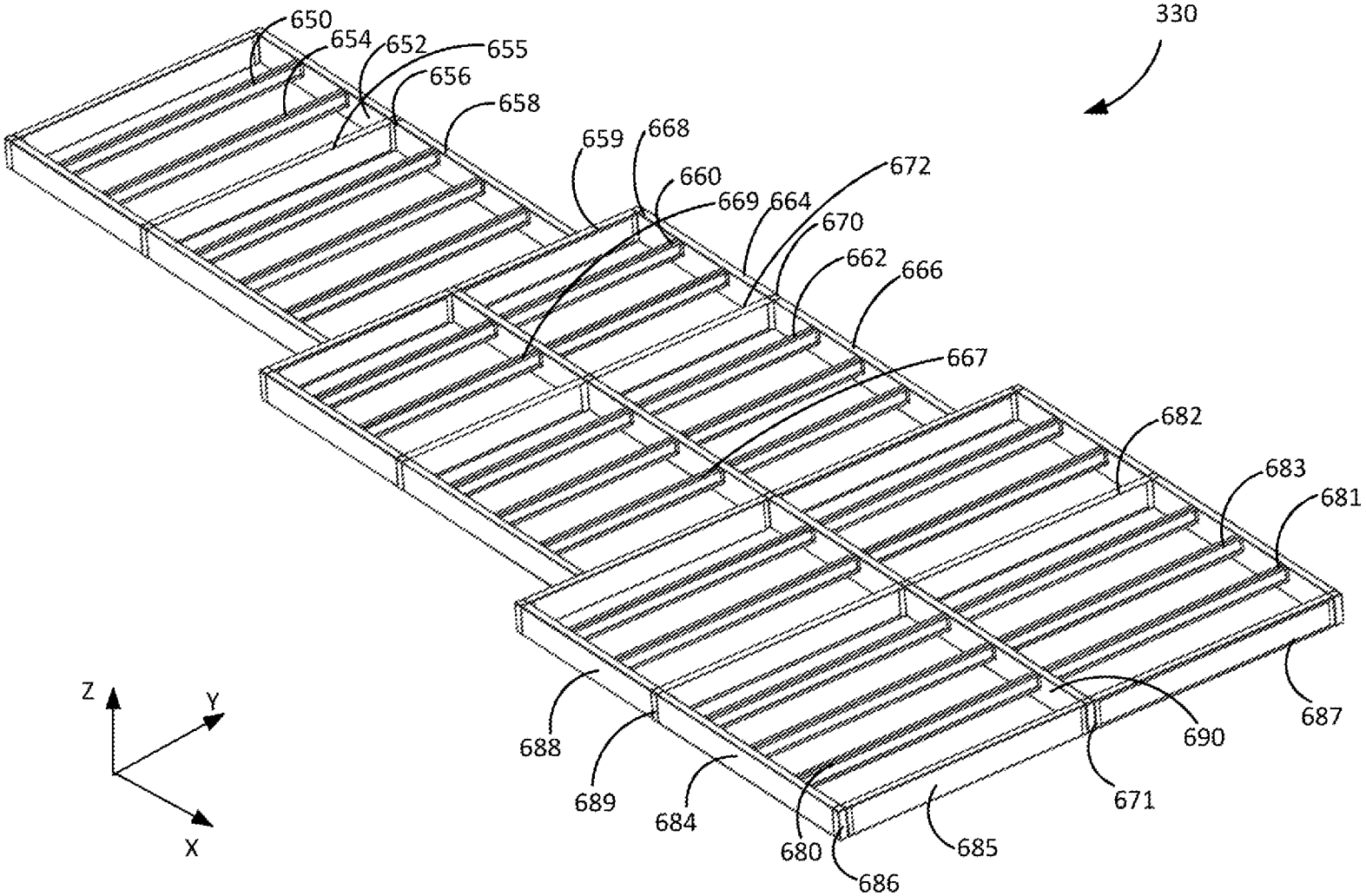
FIG. 10 depicts floor beams of a reusable modular dwelling in accordance with some embodiments of the present disclosure.

An alternative view of floor support grid 330 is depicted in FIG. 10. As shown, the floor support grid 330 may comprise a plurality of floor beams along the lines of floor beam 82 (as shown in FIG. 2). The floor support grid 330 in FIG. 10 may be understood to be similar in its structure to the roof grid 300 illustrated in FIG. 5 and described above, though other embodiments are possible.

In some embodiments, floor beams 82 of the floor support grid 330 in FIG. 10 may be coupled together to achieve the desired dimensions of floor support grid 330. In the embodiment of FIG. 10, for example, interior floor beams (e.g., 650, 654, 660, 662, 667, 669, 680, 681, 683) (which are I-beams) may each be configured to couple to one or more perimeter floor beams (e.g., perimeter floor beams 652, 658, 659, 664, 666, 684, 685, 687, 688, 690) via pins or bolts inserted through holes in both beams.

Figure 11:
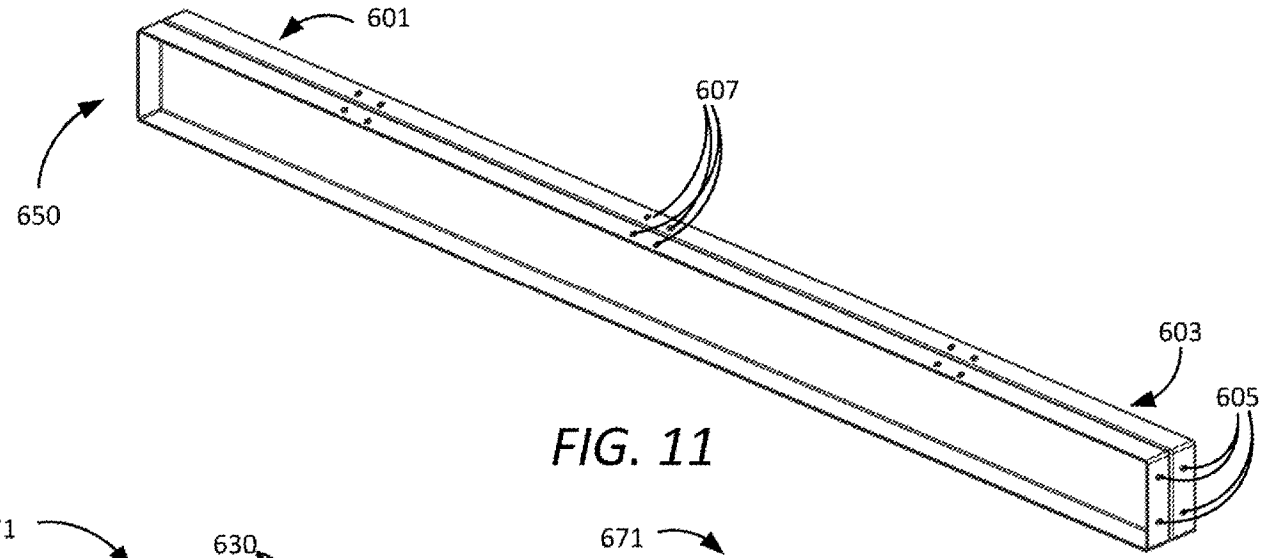
FIG. 11 depicts a floor beam of a reusable modular dwelling in accordance with some embodiments of the present disclosure.

Beams belonging to the grid 330 may have various configurations depending on whether the beam is an interior floor beam or perimeter floor beam. With reference to FIG. 11, beam 650 is an interior floor beam (joist) that has an I-shaped cross-sectional profile. Perimeter floor beams such as beams 652 and 658 may be configured so as to have a substantially rectangular cross-sectional profile, such as a box beam. Floor support grid 330 may also include one or more "perimeter-type" floor beams (box beams), such as beams 655, 672, and 682, located at the center (or a central) part of the room to provide additional support to the flooring. These central box floor beams may also be configured so as to have a substantially rectangular cross-sectional profile. However, in other embodiments, the beams of the floor support grid 330 may have various other cross-sectional profile shapes. It will be noted that interior floor beams 669 and 667 may have features similar to perimeter floor beams and central box beams, although the interior floor beams are positioned within an interior portion of the floor support grid 330 and are coupled to perimeter floor beams on a first side and a second side of each of the beams 669 and 667.

Central box floor beam 655 may be configured to be coupled to perimeter beam 652 and to one or more vertical wall beams via a floor node. As described in greater detail below, central box beam 655 may be coupled to a floor node 656 (or a receptacle attached thereto) that is similar to floor node 671 (shown in FIGS. 12A and 12B) and to roof node 368 (shown in FIGS. 7A and 7B) The floor node 656 is in turn coupled to a perimeter beam 652. As shown in FIG. 11, an interior beam 650 may be coupled directly to a perimeter beam 652 via a coupling mechanism such as, e.g., inserting a pin or bolt through one or more of a plurality of holes on end 601 (not specifically shown) or one or more of a plurality of holes 605 on end 603 of beam 650 when the beam 650 is positioned adjacent to one or more corresponding holes in a receptacle of the perimeter beam. In other embodiments, alternate coupling mechanisms can be used, such as screws, snapping mechanisms, slotting features (male/female), and reversible glues, Velcro, or other connectors as appropriate.

Referring once again to FIG. 10, the floor support grid 330 may include one or more floor nodes, which may, in some embodiments, be similar to exemplary floor nodes 656, 668, 670, 686, and 689. In particular, the floor nodes on FIG. 10 are configured for receiving two or more ends of two or more perimeter floor beams and, in some instances, at least one end of a vertical wall beam and/or at least one central box floor beam. FIG. 10 illustrates the connection of the floor nodes to a particular number and configuration of beams, however various numbers and configurations of floor nodes may be implemented in some embodiments in order to achieve a desired configuration of the floor grid 330 (the configuration of which may be mandated in part by the placement of, e.g., the wall and roof grids of the modular structure 5). It will be understood that, although exemplary nodes are identified in FIG. 10 and discussed herein, the floor support grid 330 may have other nodes in different embodiments, with such floor nodes of the floor support grid 330 being configured in various ways to achieve the functionality described herein.

Figure 12B:
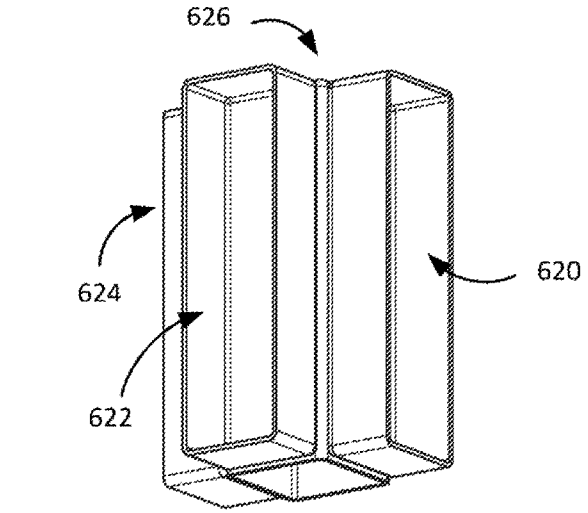
FIG. 12B depicts an alternative view of a floor node of a reusable modular dwelling system in accordance with some embodiments of the present disclosure.
Figure 12A:
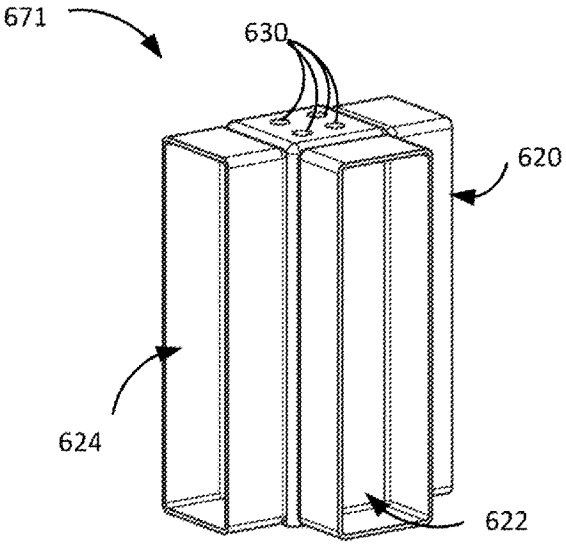
FIG. 12A depicts a floor node of a reusable modular dwelling system in accordance with some embodiments of the present disclosure.

FIGS. 12A and 12B depict views of floor node 671 of the reusable modular dwelling system in accordance with some embodiments of the present disclosure. The floor node 671 has in a preferred embodiment, a height equal to a height of a perimeter beam. The width and depth dimensions may in one embodiment be 80 mm [3.15 inches]×80 mm [3.15 inches], however such many vary in different embodiment. In some embodiments, the floor node may have a first receptacle 620, a second receptacle 22, and a third receptacle 624 for receiving respective ends of a first floor beam, a second floor beam, and a third floor beam. In a preferred embodiment, each receptacle is detachably coupleable to the node via pins, bolts, screws, slots, or the like, however, other embodiments are possible where the receptacles are integral with the node. In some embodiments, an opening of the first receptacle 620 may be oriented essentially orthogonally to an opening of the second receptacle 622. The second receptacle 622 may be oriented essentially orthogonally to an opening of the third receptacle 624. In this regard, a beam that is inserted into the first receptacle 620 may be oriented essentially orthogonally to a beam inserted in to the second receptacle 622 and in the same plane as a beam inserted into the third receptacle 624.

As an example, floor node 671 has a first receptacle 620, a second receptacle 622 and a third receptacle 624. An end of beam 685 may be inserted into receptacle 620, an end of floor beam 690 may be inserted into receptacle 622, and an end of floor beam 687 can be inserted into receptacle 624. Another receptacle (not specifically shown) can be coupled to the top of the node 671 via pins or bolts inserted into one or more holes 630 in the top 626 of the floor node. This additional receptacle sitting on node 671 is arranged with a tube opening so as to receive and couple to an end of a vertical wall beam. In some embodiments, ends of floor beams and/or wall beams may be coupled to nodes of the floor support grid 330 by slip fitting the ends of the beams into the corresponding receptacles or tube openings of the nodes, however, in some embodiments, alternate methods of coupling may be used (for example, pins, bolts, screws, or the like) to couple beams to the nodes as described above with regard to the nodes of FIGS. 7A and 7B above.

In a manner similar to the nodes of FIGS. 7A and 7B described above, floor nodes 668 and 686 illustrated in FIG. 10 each have detachable receptacles that are oriented at approximately right angles with respect to one another. In a preferred embodiment, the receptacles are detachably connected to the nodes via pins, bolts, screws, slots, or other appropriate connectors. Additionally, in some embodiments, (not specifically shown in FIGS. 12A and 12B), a node may have receptacles with openings that are oriented at approximately 180° relative to one another. As an example, floor nodes 656, 670, 671, and 689 of FIG. 10 have receptacles with openings positioned approximately 180° relative to one another. In some embodiments, openings of receptacles of floor nodes may be oriented at other angles, such as when such orientation is required to achieve a desired configuration for a floor support grid 330.

With reference to FIG. 10, node 686 may have receptacles that are oriented in a manner similar to the receptacles of node 668 (approximately orthogonally). Node 686 may also be configured so as to receive and couple to an end of perimeter beam 684, an end of perimeter beam 685. Similarly, node 670 may be configured to receive an end of perimeter beam 666, an end of perimeter beam 664, and an end of central box beam 672. The receptacles of node 670 are positioned such that their openings are oriented at approximately 90° from one another, with the ends that take in the ends of the two perimeter beams being positioned 180° from one another. Node 689 may be configured to receive an end of beam 688, an end of beam 684, and an end of the central box beam. The receptacles of node 689 are also positioned such that their openings are oriented at approximately 90° from one another, with the receptacles that take in the ends of the two perimeter beams being positioned 180° from one another. Of course, other arrangements of the nodes and floor beams are possible in other embodiments.

In some embodiments, floor beam 650 may be positioned substantially orthogonally to a vertical wall beam when coupled to it. However, in alternate embodiments, the floor beam 650 may be arranged at an angle from the vertical wall beam. In some embodiments, floor beam 650 (as well as other interior, central box, or perimeter beams) may be configured with holes 607, spaced apart by respective multiples of T, which are used in some embodiments to connect subfloor panels 130 (or other insulation panels) to the floor beams. In addition, the beam 650 may alternately or additionally have lightening holes (not specifically shown) for reducing weight of the beam 650.

Floor beams 82 may have dimensions corresponding to the two-unit system described herein, which dimensions are selected to permit assembly of the floor support grid 330 in a manner that supports the desired configuration of the modular structure 5 (that is, the configuration mandated by the placement of the roof and floor grids and the placement of the wall beams connecting the roof and floor grids). In other embodiments, floor beams 82 may use different dimensions. With regard to the interior floor beam 650 shown in FIG. 11, the interior floor beams are designed to connect to the perimeter floor beams, which are separated by a distance of a multiple of U (between the longitude center of the beams). Therefore, in the illustrated embodiment of FIGS. 10 and 11, beam 650 has a length of 4U−½ floor beam width−½ floor beam width. In alternate embodiments, where the width of the perimeter beams is insignificant, the length of beam 650 may be approximately 4U. Additionally, as described with respect to roof beams, perimeter floor beams and central box floor beams are designed to be of a length that connects the centers of the floor nodes to which they connect, and therefore, have an actual length of a multiple of U−½ floor node width−½ floor node width, to bridge the distance between the centers of the nodes. The dimensions of the floor beams may vary from the U and T measurements (though sized standardly for fabrication), however, it will be understood that the beam is sized so as to allow it to couple to the floor grid in conformance with U/T sizing. In one exemplary embodiment, an interior (I) floor beam may have dimensions of 120 mm [4.72 inches]× 80 mm [3.15 inches], while the perimeter (box) beams and central box beams may have dimensions of 260 mm [10.24 inches]×80 mm [3.15 inches], though other dimensions are possible and may, in other embodiments, be equally effective. In the embodiment of FIG. 11, the beams of floor support grid 330 may have dimensions and features similar to those of exemplary beam 650, but other dimensions and features are possible in other embodiments. Additionally, as described above with respect to wall beams, the dimensions of the floor beams may differ in different parts of the structure 5 to accommodate the additional support needed at the sides of the structure and/or near windows and doors.

In another embodiment (not shown) where the structure 5 has multiple floors, one or more floor grids 330 may be arranged at different floor levels of the structure 5 as successively higher floors. The one or more floor grids 300 may be connected by and to vertical wall beams in a manner similar to that described above with reference to FIGS. 4-12B. It will be understood that in such an embodiment, the floor grids 300 need not follow the same layout or floor plan, as different floors of the structure 5 may contain, for example, respectively different numbers or dimensions of rooms. In one such embodiment, a single roof grid 300 may be located at the top of the structure 5, however, in other embodiments, where the floor area of a higher positioned floor is smaller than that of a lower positioned floor, the structure 5 may contain multiple roof grids 300, each roof grid covering various portions of the structure 5, and each roof grid being located at a different vertical height on the structure 5. Of course, different arrangements of the structure may be possible in different embodiments.

Although not specifically illustrated, it may be understood that other elements may be "attached" to the structure 5 for aesthetic or utility reasons, or to conform with community or cultural standards. For example, structural attachments such as balconies, bay windows, moldings, etc., may be fit onto the structure. In this regard, the components of the attachments that couple to the structure 5 must conform to the U/T system in the manner described above, while the components that do not so couple need not follow those dimensional conventions. For example, a balcony may contain framing that follows the U/T system so as to couple to wall beams or other supportive elements. However, the balcony may extend out from the structure 5 to a variable length (assuming such is structurally supportable). It will be generally understood, however, that even such variable components (or other attachments) will still be standardized in dimension for fabrication.

Example A

For purely exemplary purposes, one embodiment (not illustrated) of a modular structure 5 is described below as "Example A". The exemplary structure is a single room of a house, similar but not identical to room 10 of FIG. 1. The exemplary structure is generally rectangular in nature, having a width (y-axis) of 8U, a depth (x-axis) of 7U, and a height (z-axis) of 40T, with U measuring 600 mm [23.62 inches] and T measuring 100 mm [3.94 inches].

A y-axis (width) wall of the exemplary structure may include vertical wall beams at nine (9) horizontally-spaced positions, each spaced horizontally apart (from a respective center point) at a distance of 1U. Some of the nine positions may contain two vertical wall beam portions, separated by a window (similar to FIG. 8). An x-axis (depth) wall of the exemplary structure may include vertical wall beams 76 at eight (8) horizontally-spaced positions, each spaced horizontally apart from the next at a distance of 1U. A roof may be arranged over the exemplary structure, the roof having a width of 8U and a depth of 7U. A floor may be arranged at the bottom of the room 10, the floor having a width of 8U and a depth of 7U. The placement of the floor, the roof, and the placement of the vertical wall beams on the y-axis wall and x-axis wall connecting the floor and the roof of the exemplary structure defines the structure of the room, such that the components described below must adhere to the structural configuration requirements set by the placement and dimensions of the above-described vertical 1 beams. In other words the roof, floor, and aforementioned vertical beams mandate a particular structural schema for the remaining modular components of the room 10.

The y-axis wall may include one or more horizontal beams 456 connected to the vertical wall beams via pins inserted through holes in the horizontal beams and through holes located at the connecting points of the vertical wall beams. Additionally, a door of width 12T and height 23T (representing the opening between the axes of the bordering wall beams and not accounting for the size of the framing and any sliding/hinging mechanism) may be positioned in the y-axis wall. The x-axis wall may also include a plurality of horizontal beams. Some of the horizontal beams may be spaced vertically apart (from a respective center point) at a distance of 1T (similar to 114, 116, 118 of FIG. 2) and some of the horizontal beams may be spaced vertically apart at a distance of 20T (similar to 458 and 460 of FIG. 8). A window of width 18T and height 20T (not accounting for the size of the framing) may be created in the x-axis wall (FIG. 1) by the spacing between two vertical railings, with respective horizontal beams delineating the top and the bottom of the window.

The remaining modular components will be described herein with respect to U and T values, however, it will be generally understood that the exemplary embodiment requires an amount of clearance or offset between interior, exterior, and insulation panels, e.g., 6 mm [0.24 inches], between each panel. For ease of understanding, it will be understood that while the length and width of the cladding and insulation paneling in the exemplary structure may be described in embodiment of Example A, as, e.g., 6T, such dimension is in actuality 6T-6 mm [0.24 inches].

The roof of the exemplary structure may have two (2) rows of seven (7) 6T-deep by 24T-wide roof panels being arranged adjacently to span across the roof (which roof had a depth of 7U and a width of 8U). A grid of seven (7) roof panels may be arranged adjacently in the x-axis direction, and two (2) roof panels are arranged adjacently in the y-axis direction (with appropriate clearance). The floor may be arranged at the bottom of the room 10, with a plurality of subfloor panels, each having a depth and width of 6T, such that 56 subfloor panels are arranged across the surface of the floor of the exemplary structure (which floor had a width of 8U and a depth of 7U). Floor cladding panels are arranged on top of the subfloor panels, to cover the whole surface area of the floor, with each floor cladding panel having dimensions of 2T×23T.

A plurality of interior cladding panels may be attached to the interior of the x-axis and y-axis walls via a snap-fit mechanism on the vertical wall beams, some interior cladding panels having a width of 6T and some having a width of 12T. On the y-axis wall, multiple whole panels with widths corresponding to multiples of T (not accounting for clearance between the panels) may be arranged, which panels taken together cover a distance of 48T (the distance encompassing all the vertical beams). On the x-axis wall, multiple whole panels with widths corresponding to multiples of T (not accounting for clearance between the panels) in various permutations, which panels taken together cover a distance of 42T (corresponding to the full 7U depth of the room). Some of the interior cladding panels have a height of 15T (half the height from the floor to the roof of the exemplary structure). Those interior cladding panels located under/over the window on the x-axis wall and over the door on the y-axis wall may have a height of 10T.

A plurality of insulating panels may be attached to respective exterior-sides of the x-axis and y-axis walls, via pins inserted into holes located at the connecting points of the vertical wall beams. The insulating panels (similar to FIG. 2) each have a width of 6T. Some of the insulating panels have a height of 20T (half the height from the ground to the roof of the exemplary structure). The insulating panels located under/over the window on the x-axis wall and over the door on the y-axis wall may have a height of 10T. Both the interior and insulating paneling described above are attached so as to fit snugly together (accounting for clearance between paneling), without alteration or further configuration (such as cutting to size) needed to fit the paneling into the dimensions mandated by the structural schema of the exemplary structure.

A plurality of horizontal exterior cladding rails (similar to FIG. 2) are positioned on the exterior of the insulating panels (attached thereto via a pin connector) on the x-axis wall of the exemplary structure. A plurality of exterior cladding panels may be connected to the exterior cladding rails via a bracket on the exterior cladding panel, but such panels are not arranged to cover the entirety of the exterior of the x-axis wall. The exterior cladding panels have a width of 6T and a height of 20T.

The exemplary structure described above in Example A (which lays out just one possible structure and implementation of many) allows for a high degree of configuration when designing and assembling a modular structure, within the dimensions of the structural schema set by the initial configuration of the vertical and horizontal beams. For example, in an embodiment where a property owner wishes to remove the window located on the x-axis wall of the above-described assembled exemplary structure Example A, such change can be made through a relatively-simple modification. First, one or more assemblers remove the exterior cladding panels and the horizontal exterior cladding rails from the insulating panels, by removing the pins connecting the horizontal exterior cladding rails thereto. Next, the assemblers remove the pins connecting the holes in the insulating panels on the x-axis wall to the holes located at the connecting points of the vertical wall beams on the x-axis wall. Next, the assemblers unsnap the interior cladding panels from the vertical wall beams. In some configurations, the assemblers also may need to remove the floor and roof paneling of the room. Next, the assemblers remove the horizontal railings bounding the top and bottom of the window on the x-axis wall (by removing the pins connecting those railings to the vertical wall beams on the x-axis wall), and thereafter replace the portions of the vertical wall beams bordering the window with vertical wall beams of a height that spans from the floor to the ceiling. The assemblers then attach additional horizontal railings as necessary, and then reattach (and/or additionally attach) interior cladding panels, insulating panels, and exterior cladding railings and panels. Each of the panels which was previously sized at height 10T to accommodate the placement of the window on the x-axis wall may be replaced by panels with height 20T (half the height of the structure), such replacement paneling being in correspondence with the other panels (e.g., on the y-axis wall).

The systems described herein forms a highly-modifiable building structure that can be assembled and disassembled with relatively limited labor requirements, i.e., a small team of relatively-untrained assemblers can set up the structure in a reasonable amount of time. As one example, the structure of FIG. 1 may in some circumstances be assembled by a team of four (4) assemblers within one or a few days. Because of the ease and speed of assembly and disassembly, the system disclosed herein may be broadly used in a variety of situations where temporary or semi-permanent housing may be useful, for example, in short or long term rentals, disaster relief, low-income housing, temporary event housing, etc. The structures disclosed in the embodiments and the description herein are highly-modifiable, yet conform to a set standard of base units for their dimensions, thus allowing for consistency of manufacturing, ease of transport and assembly, and predictably reliable, structurally sound options for configuration. In addition, a structure according to a system described herein can be disassembled into its component parts without any structural damage to those parts, allowing for reuse, reconfiguration, and/or recycling of those parts in a replacement or alternate structure. Because of the reusability of the modular components, high-quality materials may be used, thereby improving the durability of the material, their weather and/or environment fitness, their aesthetic presentation, and/or their appeal to renters or occupants of the space.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

As a further example, variations of apparatus or process parameters (e.g., dimensions, configurations, components, process step order, etc.) may be made to further optimize the provided structures, devices and methods, as shown and described herein. In any event, the structures and devices, as well as the associated methods, described herein have many applications. Therefore, the disclosed subject matter should not be limited to any single embodiment described herein, but rather should be construed in breadth and scope in accordance with the appended claims.

What is claimed is:

1. A structure comprising:

a plurality of vertical beams, wherein (a) a first vertical beam and a second vertical beam, of the plurality of vertical beams, are positioned so as to be spaced apart from each other by a distance equal to a value U, (b) each vertical beam of the plurality of vertical beams is positioned so as to be spaced apart from the other vertical beams, of the plurality of vertical beams, by a distance equal to a respective multiple of U, and (c) each vertical beam of the plurality of vertical beams is configured to have a plurality of coupling points, the coupling points being spaced vertically apart from each other by a distance equal to a value T, the value of T being less than the value of U;

a plurality of horizontal beams, each horizontal beam of the plurality of horizontal beams being configured to couple to and detach from at least two vertical beams, of the plurality of vertical beams, at the coupling points of the at least two vertical beams, wherein each horizontal beam is positioned so as to be spaced apart from the other horizontal beams, of the plurality of horizontal beams, by a distance equal to a respective multiple of T;

at least one interior panel configured to couple to and detach from at least one of: (a) one or more of the plurality of vertical beams and (b) one or more of the plurality of horizontal beams, wherein the at least one interior panel has a horizontal width equal to a multiple of U minus an offset value;

at least one insulating panel configured to couple to and detach from one or more of the plurality of vertical beams, wherein the at least one insulating panel has a horizontal width equal to a multiple of T minus the offset value; and at least one exterior panel configured to couple to and detach from the at least one insulating panel, wherein the at least one exterior panel has a horizontal width equal to a multiple of T minus the offset value.

2. The structure of claim 1, wherein U equals 600 mm (23.62 inches), and wherein T equals 100 mm (3.94 inches).

3. The structure of claim 1, wherein T is an integer multiple of U.

4. The structure of claim 1, wherein the offset value is a width of a respective said vertical beam of the plurality of vertical beams.

5. The structure of claim 1, wherein the at least one insulating panel has a layered structure comprising at least polyurethane, insulating foam, and a sheer base material.

6. The structure of claim 1, wherein the at least one interior panel is configured to couple to and detach from (a) one or more of the plurality of vertical beams and (b) one or more of the plurality of horizontal beams, via a snap-fit connection.

7. The structure of claim 1, further comprising a hole located in a first horizontal beam of the plurality of horizontal beams, wherein the first horizontal beam is configured to couple to and detach from a first vertical beam of the at least two vertical beams, at a respective said coupling point of the first vertical beam, via insertion of a pin or a bolt through both the hole located in the first horizontal beam and the respective coupling point of the first vertical beam.

8. The structure of claim 1, wherein the at least one insulating panel includes:

a first insulating panel with a first vertical height equal to a first multiple of T minus a second offset value, and a second insulating panel with a second vertical height equal to a second multiple of T minus the second offset value, the second vertical height being smaller than the first vertical height.

9. The structure of claim 8, wherein the second offset value is a height of a respective said horizontal beam of the plurality of horizontal beams.

10. A housing system comprising:

(1) a first housing structure comprising:

(a) two or more vertical beams;

(b) one or more horizontal beams, each horizontal beam being coupleable to and detachable from at least two vertical beams at coupling points of the at least two vertical beams;

(c) an interior panel configured to be coupleable to and detachable from at least one of: (i) one or more of the vertical beams or (ii) one or more of the horizontal beams, such that a structural condition of the interior panel, a structural condition of the one or more of the vertical beams, and a structural condition of the one or more of the horizontal beams remain the same prior to a coupling of the interior panel and after a detachment of the interior panel; and (d) an insulating panel configured to be coupleable to and detachable from one or more of the vertical beams, such that a structural condition of the insulating panel and a structural condition of the one or more of the vertical beams remain the same prior to a coupling of the insulating panel and after a detachment of the insulating panel, wherein the two or more vertical beams and the one or more horizontal beams of the first housing structure are arranged in a first configuration, and (2) a second housing structure comprising a plurality of vertical beams and a plurality of horizontal beams, wherein the plurality of vertical beams and the plurality of horizontal beams of the second housing structure are arranged in a second configuration that is different than the first configuration of the first housing structure, and wherein each of (a) the interior panel of the first housing structure and (b) the insulating panel of the first housing structure are detachable from the first housing structure and coupleable to the plurality of vertical beams of the second housing structure and to the plurality of horizontal beams of the second housing structure so as to conform with the second configuration.

11. A modular structure comprising:

(a) a foundation having at least one adjustable-height pier;

(b) a floor support grid having a first side and a second side that is opposite to the first side, wherein the at least one adjustable-height pier is configured to couple to and detach from the first side of the floor support grid, the floor support grid comprising a plurality of interior floor beams and a plurality of perimeter floor beams, wherein the plurality of interior floor beams includes at least a first interior floor beam and a second interior floor beam that is positioned at a first distance from the first interior floor beam, wherein each of the first interior floor beam and the second interior floor beam is configured to couple to and detach from at least one perimeter floor beam of the plurality of perimeter floor beams;

(c) a floor positioned adjacent to the second side of the floor support grid, the floor having a plurality of floor panels configured to fit together detachably;

(d) a wall having a first side and a second side that is opposite to the first side, the wall being positioned on the second side of the floor support grid, and the wall including:

(i) a plurality of vertical wall beams and a plurality of horizontal wall beams, the plurality of vertical wall beams including a first vertical wall beam and a second vertical wall beam that is positioned at the first distance from the first vertical wall beam, at least one of the plurality of horizontal wall beams being configured to couple to and detach from the first vertical wall beam and the second vertical wall beam;

(ii) at least one interior cladding panel having a first side and a second side that is opposite to the first side of the at least one interior cladding panel, wherein the first side of the at least one interior cladding panel forms a portion of the first side of the wall, the at least one interior cladding panel including a first interior rail and a second interior rail, the first interior rail and the second interior rail being positioned on the second side of the at least one interior cladding panel and being configured to couple to and detach from the at least one interior cladding panel to the first vertical wall beam and the second vertical wall beam, wherein the second interior rail is positioned at a second distance from the first interior rail;

(iii) at least one insulating panel having a first side and a second side that is opposite to the first side, the second side of the at least one insulating panel being positioned adjacent to the second side of the wall, wherein the first side of the at least one insulating panel is configured to couple to and detach from the first vertical wall beam and the second vertical wall beam, and wherein the second side of the at least one insulating panel has a first exterior rail and second exterior rail; and (iv) at least one exterior cladding panel having a first side and a second side that is opposite to the first side of the at least one exterior cladding panel, the first side of the at least one exterior cladding panel being configured to couple to and detach from the first exterior rail and second exterior rail, wherein the second side of the at least one exterior cladding panel forms a portion of the second side of the wall; and (e) a roof having a variable pitch, the roof being positioned adjacent to the wall, and being configured to couple to and detach from to at least one of the plurality of horizontal wall beams.

* * * * *